US010169957B2

(12) United States Patent
Hightower et al.

(10) Patent No.: US 10,169,957 B2
(45) Date of Patent: Jan. 1, 2019

(54) MULTIPLE PLAYER GAMING STATION INTERACTION SYSTEMS AND METHODS

(71) Applicant: IGT, Las Vegas, NV (US)

(72) Inventors: Aaron Hightower, Las Vegas, NV (US); William McMaster, Las Vegas, NV (US); Gregory H. Parrott, Reno, NV (US); Alex Popovich, Las Vegas, NV (US)

(73) Assignee: IGT, Las Vegas, NV (US)

( * ) Notice: Subject to any disclaimer, the term of this patent is extended or adjusted under 35 U.S.C. 154(b) by 313 days.

(21) Appl. No.: 14/618,679

(22) Filed: Feb. 10, 2015

(65) Prior Publication Data

US 2015/0228146 A1 Aug. 13, 2015

Related U.S. Application Data

(60) Provisional application No. 61/939,531, filed on Feb. 13, 2014.

(51) Int. Cl.
*G07F 17/32* (2006.01)

(52) U.S. Cl.
CPC ..... *G07F 17/3281* (2013.01); *G07F 17/3209* (2013.01); *G07F 17/3225* (2013.01); *G07F 17/3272* (2013.01); *G07F 17/3239* (2013.01); *G07F 17/3248* (2013.01); *G07F 17/3262* (2013.01)

(58) Field of Classification Search
CPC .. G07F 17/3239; G07F 17/32; G07F 17/3248; G07F 17/3223; G07F 17/3262; G07F 17/3209; G07F 17/3244; G07F 17/3255; G07F 17/3272; G07F 17/3274; G07F 17/3225; G07F 17/3267; G07F 17/3281
See application file for complete search history.

(56) References Cited

U.S. PATENT DOCUMENTS

| | | | |
|---|---|---|---|
| 2,743,108 | A | 4/1956 | Sanders |
| 3,167,313 | A | 1/1965 | Davenport et al. |
| 3,904,207 | A | 9/1975 | Gold |
| 4,003,578 | A | 1/1977 | Jones |

(Continued)

FOREIGN PATENT DOCUMENTS

| | | |
|---|---|---|
| AU | 199650327 | 10/1997 |
| EP | 0945837 | 9/1999 |

(Continued)

*Primary Examiner* — Justin Myhr
(74) *Attorney, Agent, or Firm* — Neal, Gerber & Eisenberg LLP

(57) ABSTRACT

Systems and methods for transferring objects from a first player to a second player within a gaming system are described herein. The method includes receiving, via a first touchscreen of the first gaming machine, a selection of an object by the first player. The method further includes receiving, via the first touchscreen, gesture information relating to the object. The method includes analyzing, by a controller of the gaming system, the gesture information. The method further includes determining, by the controller, that the object is to be transferred from the first player to the second player based at least in part on the gesture information. The method includes transferring, by the controller, the object from the first gaming machine to the second gaming machine.

42 Claims, 7 Drawing Sheets

(56) References Cited

U.S. PATENT DOCUMENTS 4,103,895 A 8/1978 Pressman et al.
4,182,515 A 1/1980 Nemeth
4,251,078 A 2/1981 Meirovitz
4,277,067 A 7/1981 Gettleman
4,323,242 A 4/1982 Rosenfeld
4,335,809 A 6/1982 Wain
4,363,485 A 12/1982 Edwall
4,448,419 A 5/1984 Telnaes
4,511,143 A 4/1985 Sankrithi
4,548,410 A 10/1985 Morrone
4,582,324 A 4/1986 Koza et al.
4,593,904 A 6/1986 Graves
4,614,342 A 9/1986 Takashima
4,618,150 A 10/1986 Kimura
4,624,459 A 11/1986 Kaufman
4,652,998 A 3/1987 Koza et al.
4,659,087 A 4/1987 Shen et al.
4,695,053 A 9/1987 Vazquez, Jr. et al.
4,743,022 A 5/1988 Wood
4,760,245 A 7/1988 Fukaya
4,775,155 A 10/1988 Lees
4,805,907 A 2/1989 Hagiwara
4,807,884 A 2/1989 Breeding
4,820,908 A 4/1989 Wei
4,836,553 A 6/1989 Suttle et al.
4,837,728 A 6/1989 Barrie et al.
4,844,464 A 7/1989 Berge
4,850,592 A 7/1989 Winter
4,861,041 A 8/1989 Jones et al.
4,871,171 A 10/1989 Rivero
4,906,005 A 3/1990 Manabe
4,926,327 A 5/1990 Sidley
4,948,133 A 8/1990 Helm et al.
5,016,879 A 5/1991 Parker et al.
5,019,973 A 5/1991 Wilcox et al.
5,033,744 A 7/1991 Bridgeman et al.
5,042,809 A 8/1991 Richardson
5,080,368 A 1/1992 Weisser
5,083,271 A 1/1992 Thacher et al.
5,083,800 A 1/1992 Lockton
5,087,405 A 2/1992 Maker
5,098,107 A 3/1992 Boylan et al.
5,102,135 A 4/1992 Addiechi
5,116,055 A 5/1992 Tracy
5,131,655 A 7/1992 Ugawa
5,154,429 A 10/1992 LeVasseur
5,167,413 A 12/1992 Fulton
5,174,579 A 12/1992 Griffiths
5,178,390 A 1/1993 Okada
5,178,395 A 1/1993 Lovell
5,178,545 A 1/1993 Thompson
5,205,555 A 4/1993 Hamano
5,248,142 A 9/1993 Breeding
5,275,400 A 1/1994 Weingardt et al.
5,275,416 A 1/1994 Schorr et al.
5,280,909 A 1/1994 Tracy
5,288,077 A 2/1994 Jones
5,288,081 A 2/1994 Breeding
5,292,127 A 3/1994 Kelly et al.
5,333,868 A 8/1994 Goldfarb
5,334,836 A 8/1994 Filo
5,342,047 A 8/1994 Heidel et al.
5,342,049 A 8/1994 Wichinsky et al.
5,344,144 A 9/1994 Canon
5,355,442 A 10/1994 Paglieroni et al.
5,362,053 A 11/1994 Miller
5,364,105 A 11/1994 Jones
5,377,973 A 1/1995 Jones et al.
5,377,993 A 1/1995 Josephs
5,390,934 A 2/1995 Grassa
5,393,057 A 2/1995 Marnell, II
5,393,061 A 2/1995 Manship et al.
5,393,067 A 2/1995 Paulsen et al.
5,407,200 A 4/1995 Zalabak
5,411,271 A 5/1995 Mirando
5,417,430 A 5/1995 Breeding
5,429,361 A 7/1995 Raven et al.
5,431,407 A 7/1995 Hofberg et al.
5,449,173 A 9/1995 Thomas et al.
5,452,899 A 9/1995 Skratulia et al.
5,454,570 A 10/1995 Karal
5,476,259 A 12/1995 Weingardt
5,494,296 A 2/1996 Grassa
5,509,655 A 4/1996 Ugawa
5,524,888 A 6/1996 Heidel
5,529,309 A 6/1996 Bartlett
5,531,440 A 7/1996 Dabrowski et al.
5,536,016 A 7/1996 Thompson
5,542,669 A 8/1996 Charron et al.
5,544,892 A 8/1996 Breeding
5,560,603 A 10/1996 Seelig et al.
5,564,700 A 10/1996 Celona
5,566,942 A 10/1996 Elum
5,570,885 A 11/1996 Ornstein
5,577,731 A 11/1996 Jones
5,580,309 A 12/1996 Piechowiak et al.
5,584,485 A 12/1996 Jones et al.
5,584,763 A 12/1996 Kelly et al.
5,593,349 A 1/1997 Miguel et al.
5,597,162 A 1/1997 Franklin
5,605,506 A 2/1997 Hoorn et al.
5,611,730 A 3/1997 Weiss
5,615,888 A 4/1997 Lofink et al.
5,618,045 A 4/1997 Kagan et al.
5,626,341 A 5/1997 Jones et al.
5,628,684 A 5/1997 Bouedec
5,632,485 A 5/1997 Woodland et al.
5,634,849 A 6/1997 Abecassis
5,636,838 A 6/1997 Caro
5,639,089 A 6/1997 Matsumoto et al.
5,641,730 A 6/1997 Brown
5,643,088 A 7/1997 Vaughn et al.
5,645,486 A 7/1997 Nagao et al.
5,649,705 A 7/1997 String
5,651,548 A 7/1997 French et al.
5,655,961 A 8/1997 Acres et al.
5,660,391 A 8/1997 Klasee
5,660,393 A 8/1997 Dreger
5,664,781 A 9/1997 Feola
5,664,998 A 9/1997 Seelig et al.
5,673,917 A 10/1997 Vancura
5,678,821 A 10/1997 Hedman
5,685,774 A 11/1997 Webb
5,695,188 A 12/1997 Ishibashi
5,695,400 A 12/1997 Fennell, Jr. et al.
5,697,611 A 12/1997 Kelly et al.
5,700,007 A 12/1997 Kelly et al.
5,702,304 A 12/1997 Acres et al.
5,707,285 A 1/1998 Place et al.
5,718,430 A 2/1998 Aramapakul et al.
5,720,483 A 2/1998 Trinh
5,735,742 A 4/1998 French
5,741,183 A 4/1998 Acres et al.
5,743,523 A 4/1998 Kelly et al.
5,743,800 A 4/1998 Huard et al.
5,752,882 A 5/1998 Acres et al.
5,755,440 A 5/1998 Sher
5,755,619 A 5/1998 Matsumoto et al.
5,761,647 A 6/1998 Boushy
5,766,074 A 6/1998 Cannon et al.
5,769,716 A 6/1998 Saffari et al.
5,772,509 A 6/1998 Weiss
5,779,544 A 7/1998 Seelig et al.
5,779,545 A 7/1998 Berg et al.
5,779,549 A 7/1998 Walker et al.
5,781,647 A 7/1998 Fishbine et al.
5,788,573 A 8/1998 Baerlocher et al.
5,788,574 A 8/1998 Ornstein et al.
5,794,964 A 8/1998 Jones et al.
5,795,225 A 8/1998 Jones et al.
5,806,846 A 9/1998 Lofink et al.
5,813,672 A 9/1998 Loud, Jr.
5,816,575 A 10/1998 Keller
5,820,459 A 10/1998 Acres et al.

(56) References Cited

U.S. PATENT DOCUMENTS 5,823,873 A 10/1998 Moody
5,823,874 A 10/1998 Adams
5,830,063 A 11/1998 Byrne
5,833,536 A 11/1998 Davids et al.
5,833,537 A 11/1998 Barrie
5,836,817 A 11/1998 Acres et al.
5,836,819 A 11/1998 Ugawa
5,839,730 A 11/1998 Pike
5,839,955 A 11/1998 Mangano et al.
5,845,906 A 12/1998 Wirth
5,848,932 A 12/1998 Adams
5,851,011 A 12/1998 Lott
5,851,148 A 12/1998 Brune et al.
5,855,514 A 1/1999 Kamille
5,855,515 A 1/1999 Pease et al.
5,857,678 A 1/1999 Coleman et al.
5,863,041 A 1/1999 Boylan et al.
5,873,781 A 2/1999 Keane
5,876,284 A 3/1999 Acres et al.
5,882,261 A 3/1999 Adams
5,890,962 A 4/1999 Takemoto
5,893,718 A 4/1999 O'Donnell
5,911,418 A 6/1999 Adams
5,911,419 A 6/1999 Delaney et al.
5,927,714 A 7/1999 Kaplan
5,931,467 A 8/1999 Kamille
5,934,999 A 8/1999 Valdez
5,935,002 A 8/1999 Falciglia
5,941,769 A 8/1999 Order
5,947,820 A 9/1999 Morro et al.
5,947,822 A 9/1999 Weiss
5,951,009 A 9/1999 Miyamoto et al.
5,951,397 A 9/1999 Dickinson
5,961,384 A 10/1999 Robinson
5,967,894 A 10/1999 Kinoshita et al.
5,976,015 A 11/1999 Seelig et al.
5,976,016 A 11/1999 Moody et al.
5,980,384 A 11/1999 Barrie
5,984,310 A 11/1999 English
5,984,782 A 11/1999 Inoue
5,997,400 A 12/1999 Seelig et al.
5,997,401 A 12/1999 Crawford
6,004,207 A 12/1999 Wilson, Jr. et al.
6,007,066 A 12/1999 Moody
6,007,426 A 12/1999 Kelly et al.
6,012,719 A 1/2000 Webb
6,012,982 A 1/2000 Piechowiak et al.
6,012,983 A 1/2000 Walker et al.
6,015,346 A 1/2000 Bennett
6,019,369 A 2/2000 Nakagawa et al.
6,033,307 A 3/2000 Vancura
6,039,648 A 3/2000 Guinn et al.
6,039,650 A 3/2000 Hill
6,047,963 A 4/2000 Pierce et al.
6,050,895 A 4/2000 Luciano, Jr. et al.
6,053,823 A 4/2000 Mathews
6,056,641 A 5/2000 Webb
6,056,642 A 5/2000 Bennett
6,059,289 A 5/2000 Vancura
6,059,658 A 5/2000 Mangano et al.
6,062,981 A 5/2000 Luciano, Jr.
6,068,552 A 5/2000 Walker et al.
6,071,192 A 6/2000 Weiss
6,077,163 A 6/2000 Walker et al.
6,082,887 A 7/2000 Feuer et al.
6,083,105 A 7/2000 Ronin et al.
6,089,976 A 7/2000 Schneider et al.
6,089,978 A 7/2000 Adams
6,093,102 A 7/2000 Bennett
6,095,525 A 8/2000 Terminel
6,102,798 A 8/2000 Bennett
6,105,001 A 8/2000 Masi et al.
6,110,039 A 8/2000 Oh
6,110,041 A 8/2000 Walker et al.
6,110,043 A 8/2000 Olsen
6,120,031 A 9/2000 Adams
6,120,377 A 9/2000 McGinnis, Sr. et al.
6,126,541 A 10/2000 Fuchs
6,126,542 A 10/2000 Fier
6,126,547 A 10/2000 Ishimoto
6,131,908 A 10/2000 Palmer
6,134,556 A 10/2000 Shin
6,135,884 A 10/2000 Hedrick et al.
6,135,885 A 10/2000 Lermusiaux
6,139,013 A 10/2000 Pierce et al.
6,142,873 A 11/2000 Weiss et al.
6,142,874 A 11/2000 Kodachi et al.
6,142,875 A 11/2000 Kodachi et al.
6,142,876 A 11/2000 Cumbers
6,146,273 A 11/2000 Olsen
6,152,448 A 11/2000 Cudlipp
6,152,823 A 11/2000 Lacoste et al.
6,155,925 A 12/2000 Giobbi et al.
6,159,095 A 12/2000 Frohm et al.
6,159,096 A 12/2000 Yoseloff
6,159,097 A 12/2000 Gura
6,159,098 A 12/2000 Slomiany et al.
6,162,122 A 12/2000 Acres et al.
6,165,070 A 12/2000 Nolte et al.
6,174,233 B1 1/2001 Sunaga et al.
6,174,235 B1 1/2001 Walker et al.
6,174,237 B1 1/2001 Stephenson
6,176,487 B1 1/2001 Eklund et al.
6,179,291 B1 1/2001 Vancura
6,186,894 B1 2/2001 Mayeroff
6,190,255 B1 2/2001 Thomas et al.
6,193,608 B1 2/2001 Walker et al.
6,203,010 B1 3/2001 Jorasch et al.
6,203,427 B1 3/2001 Walker et al.
6,209,869 B1 4/2001 Mathews
6,210,275 B1 4/2001 Olsen
6,210,277 B1 4/2001 Stefan
6,210,279 B1 4/2001 Dickinson
6,217,022 B1 4/2001 Astaneha
6,217,448 B1 4/2001 Olsen
6,220,593 B1 4/2001 Pierce et al.
6,220,961 B1 4/2001 Keane et al.
6,224,482 B1 5/2001 Bennett
6,224,484 B1 5/2001 Okuda et al.
6,227,969 B1 5/2001 Yoseloff
6,231,442 B1 5/2001 Mayeroff
6,231,445 B1 5/2001 Acres
6,234,896 B1 5/2001 Walker et al.
6,234,897 B1 5/2001 Frohm et al.
6,237,917 B1 5/2001 Timpano
6,238,288 B1 5/2001 Walker et al.
6,244,958 B1 6/2001 Acres
6,254,481 B1 7/2001 Jaffe
6,257,981 B1 7/2001 Acres et al.
6,261,177 B1 7/2001 Bennett
6,264,560 B1 7/2001 Goldberg et al.
6,267,669 B1 7/2001 Luciano, Jr. et al.
6,270,408 B1 8/2001 Sakamoto et al.
6,270,409 B1 8/2001 Shuster
6,270,411 B1 8/2001 Gura et al.
6,270,412 B1 8/2001 Crawford et al.
6,273,420 B1 8/2001 Brooks
6,279,910 B1 8/2001 De Keller
6,293,866 B1 9/2001 Walker et al.
6,296,568 B1 10/2001 Tracy
6,299,536 B1 10/2001 Hill
6,302,793 B1 10/2001 Fertitta, III et al.
6,305,686 B1 10/2001 Perrie et al.
6,306,038 B1 10/2001 Graves et al.
6,309,298 B1 10/2001 Gerow
6,309,299 B1 10/2001 Weiss
6,309,300 B1 10/2001 Glavich
6,312,330 B1 11/2001 Jones et al.
6,312,334 B1 11/2001 Yoseloff
6,313,871 B1 11/2001 Schubert
6,315,660 B1 11/2001 DeMar et al.
6,315,664 B1 11/2001 Baerlocher et al.
6,319,122 B1 11/2001 Packes, Jr. et al.
6,319,124 B1 11/2001 Baerlocher et al.

(56) References Cited

U.S. PATENT DOCUMENTS

| | | | |
|---|---|---|---|
| 6,319,127 | B1 | 11/2001 | Walker et al. |
| 6,328,649 | B1 | 12/2001 | Randall et al. |
| 6,334,814 | B1 | 1/2002 | Adams |
| 6,336,859 | B2 | 1/2002 | Jones et al. |
| 6,336,862 | B1 | 1/2002 | Byrne |
| 6,336,863 | B1 | 1/2002 | Baerlocher et al. |
| 6,340,158 | B2 | 1/2002 | Pierce et al. |
| 6,340,159 | B1 | 1/2002 | Giangrante |
| 6,345,824 | B1 | 2/2002 | Selitzky |
| 6,346,043 | B1 | 2/2002 | Colin et al. |
| 6,346,044 | B1 | 2/2002 | McCrea, Jr. |
| 6,347,996 | B1 | 2/2002 | Gilmore et al. |
| 6,350,199 | B1 | 2/2002 | Williams et al. |
| 6,358,149 | B1 | 3/2002 | Schneider et al. |
| 6,364,314 | B1 | 4/2002 | Canterbury |
| 6,364,765 | B1 | 4/2002 | Walker et al. |
| 6,364,766 | B1 | 4/2002 | Anderson et al. |
| 6,364,767 | B1 | 4/2002 | Brossard et al. |
| 6,364,768 | B1 | 4/2002 | Acres et al. |
| 6,371,852 | B1 | 4/2002 | Acres |
| 6,371,867 | B1 | 4/2002 | Webb |
| 6,374,287 | B1 | 4/2002 | Goldstein |
| 6,375,187 | B1 | 4/2002 | Baerlocher |
| 6,375,189 | B1 | 4/2002 | Jones |
| 6,375,567 | B1 | 4/2002 | Acres |
| 6,375,569 | B1 | 4/2002 | Acres |
| 6,379,245 | B2 | 4/2002 | De Keller |
| 6,379,246 | B1 | 4/2002 | Dabrowski |
| 6,386,974 | B1 | 5/2002 | Adams |
| 6,386,977 | B1 | 5/2002 | Hole |
| 6,398,218 | B1 | 6/2002 | Vancura |
| 6,398,219 | B1 | 6/2002 | Pierce et al. |
| 6,398,644 | B1 | 6/2002 | Perrie et al. |
| 6,402,147 | B1 | 6/2002 | Lo |
| 6,406,369 | B1 | 6/2002 | Baerlocher et al. |
| 6,409,602 | B1 | 6/2002 | Wiltshire et al. |
| 6,413,160 | B1 | 7/2002 | Vancura |
| 6,413,161 | B1 | 7/2002 | Baerlocher et al. |
| 6,416,408 | B2 | 7/2002 | Tracy et al. |
| 6,416,409 | B1 | 7/2002 | Jordan |
| 6,419,226 | B2 | 7/2002 | Krise et al. |
| 6,419,583 | B1 | 7/2002 | Crumby et al. |
| 6,425,823 | B1 | 7/2002 | Byrne |
| 6,425,824 | B1 | 7/2002 | Baerlocher et al. |
| 6,428,412 | B1 | 8/2002 | Anderson et al. |
| 6,435,511 | B1 | 8/2002 | Vancura et al. |
| 6,439,995 | B1 | 8/2002 | Hughs-Baird et al. |
| 6,443,837 | B1 | 9/2002 | Jaffe et al. |
| 6,450,883 | B1 | 9/2002 | O'Halloran |
| 6,454,651 | B1 | 9/2002 | Yoseloff |
| 6,460,848 | B1 | 10/2002 | Soltys et al. |
| 6,461,240 | B1 | 10/2002 | Perkins |
| 6,461,241 | B1 | 10/2002 | Webb et al. |
| 6,464,582 | B1 | 10/2002 | Baerlocher et al. |
| 6,471,591 | B1 | 10/2002 | Crumby |
| 6,474,646 | B1 | 11/2002 | Webb |
| 6,475,088 | B1 | 11/2002 | Jones et al. |
| 6,481,713 | B2 | 11/2002 | Perrie et al. |
| 6,482,089 | B2 | 11/2002 | Demar et al. |
| 6,485,368 | B2 | 11/2002 | Jones et al. |
| 6,491,584 | B2 | 12/2002 | Graham et al. |
| 6,494,785 | B1 | 12/2002 | Gerrard et al. |
| 6,497,409 | B2 | 12/2002 | Mathews |
| 6,498,590 | B1 | 12/2002 | Dietz et al. |
| 6,500,068 | B2 | 12/2002 | Walker et al. |
| 6,503,145 | B1 | 1/2003 | Webb |
| 6,506,114 | B1 | 1/2003 | Estes et al. |
| 6,506,117 | B2 | 1/2003 | DeMar et al. |
| 6,506,118 | B1 | 1/2003 | Baerlocher et al. |
| 6,511,068 | B1 | 1/2003 | Sklansky et al. |
| 6,511,375 | B1 | 1/2003 | Kaminkow |
| 6,511,377 | B1 | 1/2003 | Weiss |
| 6,514,140 | B1 | 2/2003 | Storch |
| 6,514,141 | B1 | 2/2003 | Kaminkow et al. |
| 6,517,073 | B1 | 2/2003 | Vancura |
| 6,517,435 | B2 | 2/2003 | Soltys et al. |
| 6,520,856 | B1 | 2/2003 | Walker et al. |
| 6,523,831 | B2 | 2/2003 | Webb |
| 6,530,837 | B2 | 3/2003 | Soltys et al. |
| 6,532,291 | B1 | 3/2003 | McGrath |
| 6,533,276 | B2 | 3/2003 | Soltys et al. |
| 6,533,658 | B1 | 3/2003 | Walker et al. |
| 6,533,662 | B2 | 3/2003 | Soltys et al. |
| 6,537,150 | B1 | 3/2003 | Luciano et al. |
| 6,547,131 | B1 | 4/2003 | Foodman et al. |
| 6,547,242 | B1 | 4/2003 | Sugiyama et al. |
| 6,553,276 | B2 | 4/2003 | Akram et al. |
| 6,554,707 | B1 | 4/2003 | Sinclair et al. |
| 6,558,254 | B2 | 5/2003 | Baelocher et al. |
| 6,558,255 | B2 | 5/2003 | Walker |
| 6,565,434 | B1 | 5/2003 | Acres |
| 6,569,015 | B1 | 5/2003 | Baerlocher et al. |
| 6,572,469 | B2 | 6/2003 | Klitsner et al. |
| 6,572,471 | B1 | 6/2003 | Bennett |
| 6,572,472 | B1 | 6/2003 | Glavich |
| 6,572,473 | B1 | 6/2003 | Baerlocher |
| 6,575,832 | B1 | 6/2003 | Manfredi et al. |
| 6,579,178 | B1 | 6/2003 | Walker et al. |
| 6,579,180 | B2 | 6/2003 | Soltys et al. |
| 6,582,306 | B1 | 6/2003 | Kaminkow |
| 6,582,307 | B2 | 6/2003 | Webb |
| 6,589,117 | B1 | 7/2003 | Moritome et al. |
| 6,595,854 | B2 | 7/2003 | Hughs-Baird et al. |
| 6,599,185 | B1 | 7/2003 | Kaminkow et al. |
| 6,599,193 | B2 | 7/2003 | Baerlocher et al. |
| 6,602,136 | B1 | 8/2003 | Baerlocher et al. |
| 6,602,137 | B2 | 8/2003 | Kaminkow et al. |
| 6,605,002 | B2 | 8/2003 | Baerlocher |
| 6,606,602 | B1 | 8/2003 | Kolis |
| 6,607,195 | B2 | 8/2003 | Vancura |
| 6,607,438 | B2 | 8/2003 | Baerlocher et al. |
| 6,609,711 | B1 | 8/2003 | Campbell |
| 6,629,890 | B2 | 10/2003 | Johnson |
| 6,632,141 | B2 | 10/2003 | Webb et al. |
| 6,638,164 | B2 | 10/2003 | Randall et al. |
| 6,641,137 | B2 | 11/2003 | Sines et al. |
| 6,645,071 | B2 | 11/2003 | Perrie et al. |
| 6,645,073 | B2 | 11/2003 | Lemay et al. |
| 6,645,074 | B2 | 11/2003 | Thomas et al. |
| 6,648,753 | B1 | 11/2003 | Tracy et al. |
| 6,648,754 | B2 | 11/2003 | Baerlocher et al. |
| 6,648,759 | B2 | 11/2003 | Vancura |
| 6,652,378 | B2 | 11/2003 | Cannon et al. |
| 6,656,040 | B1 | 12/2003 | Brosnan et al. |
| 6,656,047 | B1 | 12/2003 | Tarantino et al. |
| 6,656,048 | B2 | 12/2003 | Olsen |
| 6,659,462 | B1 | 12/2003 | Scott |
| 6,663,488 | B1 | 12/2003 | Adams |
| 6,666,766 | B2 | 12/2003 | Baerlocher et al. |
| 6,672,975 | B1 | 1/2004 | Galloway |
| 6,676,516 | B2 | 1/2004 | Baerlocher et al. |
| 6,682,419 | B2 | 1/2004 | Webb et al. |
| 6,682,420 | B2 | 1/2004 | Webb et al. |
| 6,692,003 | B2 | 2/2004 | Potter et al. |
| 6,692,354 | B2 | 2/2004 | Tracy et al. |
| 6,692,355 | B2 | 2/2004 | Baerlocher et al. |
| 6,692,356 | B2 | 2/2004 | Baerlocher et al. |
| 6,702,289 | B1 | 3/2004 | Feola |
| 6,705,944 | B2 | 3/2004 | Luciano |
| 6,709,331 | B2 | 3/2004 | Berman |
| 6,722,976 | B2 | 4/2004 | Adams |
| 6,722,981 | B2 | 4/2004 | Kaminkow et al. |
| 6,722,982 | B2 | 4/2004 | Kaminkow et al. |
| 6,726,427 | B2 | 4/2004 | Jarvis et al. |
| 6,726,563 | B1 | 4/2004 | Baerlocher et al. |
| 6,726,565 | B2 | 4/2004 | Hughs-Baird |
| 6,733,386 | B2 | 5/2004 | Cuddy et al. |
| 6,733,389 | B2 | 5/2004 | Webb et al. |
| 6,733,390 | B2 | 5/2004 | Walker et al. |
| 6,743,094 | B2 | 6/2004 | Johnson |
| 6,743,096 | B2 | 6/2004 | Allendorf et al. |
| 6,749,200 | B2 | 6/2004 | Yurkins |
| 6,749,504 | B2 | 6/2004 | Hughs-Baird |
| 6,752,312 | B1 | 6/2004 | Chamberlain et al. |

(56) References Cited

U.S. PATENT DOCUMENTS

| | | | |
|---|---|---|---|
| 6,758,747 | B2 | 7/2004 | Baerlocher |
| 6,758,751 | B2 | 7/2004 | Soltys et al. |
| 6,761,632 | B2 | 7/2004 | Basenmer et al. |
| 6,767,284 | B1 | 7/2004 | Koza |
| 6,769,982 | B1 | 8/2004 | Brosnan |
| 6,769,983 | B2 | 8/2004 | Slomiany |
| 6,772,975 | B2 | 8/2004 | Sommerfeld et al. |
| 6,776,415 | B2 | 8/2004 | Robinson et al. |
| 6,780,107 | B2 | 8/2004 | Baerlocher et al. |
| 6,780,110 | B2 | 8/2004 | Baerlocher et al. |
| 6,780,111 | B2 | 8/2004 | Cannon et al. |
| 6,783,455 | B2 | 8/2004 | Glavich |
| 6,783,457 | B2 | 8/2004 | Hughs-Baird et al. |
| 6,786,820 | B2 | 9/2004 | Gerrard et al. |
| 6,786,824 | B2 | 9/2004 | Cannon |
| 6,789,800 | B2 | 9/2004 | Webb |
| 6,790,140 | B1 | 9/2004 | Niwa |
| 6,802,773 | B2 | 10/2004 | Moody |
| 6,808,173 | B2 | 10/2004 | Snow |
| 6,808,454 | B2 | 10/2004 | Gerrard et al. |
| 6,814,664 | B2 | 11/2004 | Baerlocher et al. |
| 6,817,944 | B2 | 11/2004 | Kaminkow et al. |
| 6,817,948 | B2 | 11/2004 | Pascal et al. |
| 6,827,348 | B1 | 12/2004 | Mitchell |
| 6,832,959 | B2 | 12/2004 | Baerlocher |
| 6,837,793 | B2 | 1/2005 | McClintic |
| 6,840,517 | B2 | 1/2005 | Snow et al. |
| 6,840,856 | B2 | 1/2005 | Stern |
| 6,843,722 | B2 | 1/2005 | Webb |
| 6,845,981 | B1 | 1/2005 | Ko |
| 6,848,994 | B1 | 2/2005 | Knust et al. |
| 6,851,674 | B2 | 2/2005 | Pierce et al. |
| 6,852,027 | B2 | 2/2005 | Kaminkow et al. |
| 6,857,958 | B2 | 2/2005 | Osawa |
| 6,863,606 | B1 | 3/2005 | Berg et al. |
| 6,869,074 | B2 | 3/2005 | Miller |
| 6,869,075 | B1 | 3/2005 | Stavinsky |
| 6,869,357 | B2 | 3/2005 | Adams et al. |
| 6,869,359 | B1 | 3/2005 | Mathews |
| 6,874,786 | B2 | 4/2005 | Bruno et al. |
| 6,875,108 | B1 | 4/2005 | Hughs-Baird |
| 6,877,748 | B1 | 4/2005 | Patroni et al. |
| 6,878,064 | B2 | 4/2005 | Huang |
| 6,884,168 | B2 | 4/2005 | Wood et al. |
| 6,884,173 | B2 | 4/2005 | Gauselmann |
| 6,887,154 | B1 | 5/2005 | Luciano, Jr. et al. |
| 6,890,255 | B2 | 5/2005 | Jarvis et al. |
| 6,893,341 | B2 | 5/2005 | Walker et al. |
| 6,896,618 | B2 | 5/2005 | Benoy |
| 6,896,620 | B1 | 5/2005 | Luciano et al. |
| 6,899,620 | B2 | 5/2005 | Kaminkow et al. |
| 6,899,625 | B2 | 5/2005 | Luciano, Jr. et al. |
| 6,902,167 | B2 | 6/2005 | Webb |
| 6,902,478 | B2 | 6/2005 | McClintic |
| 6,908,383 | B2 | 6/2005 | Baerlocher et al. |
| 6,908,390 | B2 | 6/2005 | Nguyen et al. |
| 6,913,533 | B2 | 7/2005 | Cuddy et al. |
| 6,918,830 | B2 | 7/2005 | Baerlocher |
| 6,921,333 | B2 | 7/2005 | Taguchi |
| 6,923,446 | B2 | 8/2005 | Snow |
| 6,923,724 | B2 | 8/2005 | Williams |
| 6,932,701 | B2 | 8/2005 | Glavich et al. |
| 6,932,703 | B1 | 8/2005 | Ritchie |
| 6,935,947 | B1 | 8/2005 | Singer et al. |
| 6,938,900 | B2 | 9/2005 | Snow |
| 6,942,568 | B2 | 9/2005 | Baerlocher |
| 6,958,013 | B2 | 10/2005 | Miereau et al. |
| 6,966,833 | B2 | 11/2005 | Kaminkow et al. |
| 6,969,318 | B1 | 11/2005 | Packes, Jr. et al. |
| 6,971,953 | B2 | 12/2005 | Gerrard et al. |
| 6,971,954 | B2 | 12/2005 | Randall et al. |
| 6,976,676 | B2 | 12/2005 | Adams |
| 6,984,174 | B2 | 1/2006 | Cannon et al. |
| 6,988,731 | B2 | 1/2006 | Inoue |
| 6,988,947 | B2 | 1/2006 | Baerlocher et al. |
| 6,988,948 | B2 | 1/2006 | Perrie et al. |
| 6,995,751 | B2 | 2/2006 | Falvo |
| 6,996,833 | B1 | 2/2006 | Olson et al. |
| 6,997,807 | B2 | 2/2006 | Weiss |
| 7,012,595 | B2 | 3/2006 | Lu |
| 7,029,395 | B1 | 4/2006 | Baerlocher |
| 7,030,861 | B1 | 4/2006 | Westerman et al. |
| 7,033,276 | B2 | 4/2006 | Walker et al. |
| 7,037,191 | B2 | 5/2006 | Rodgers et al. |
| 7,037,195 | B2 | 5/2006 | Schneider et al. |
| 7,040,984 | B2 | 5/2006 | Mead |
| 7,040,987 | B2 | 5/2006 | Walker et al. |
| 7,052,011 | B2 | 5/2006 | Pierce et al. |
| 7,052,392 | B2 | 5/2006 | Tessmer et al. |
| 7,056,214 | B2 | 6/2006 | Miereau et al. |
| 7,059,603 | B1 | 6/2006 | D'avanzo |
| 7,077,744 | B2 | 7/2006 | Cannon |
| 7,094,150 | B2 | 8/2006 | Ungaro et al. |
| 7,104,888 | B2 | 9/2006 | Miereau et al. |
| 7,112,137 | B2 | 9/2006 | Baerlocher et al. |
| 7,121,942 | B2 | 10/2006 | Baerlocher |
| 7,140,964 | B2 | 11/2006 | Walker et al. |
| 7,156,735 | B2 | 1/2007 | Brosnan et al. |
| 7,160,186 | B2 | 1/2007 | Cuddy et al. |
| 7,160,188 | B2 | 1/2007 | Kaminkow et al. |
| 7,168,704 | B1 | 1/2007 | Lawless |
| 7,169,044 | B2 | 1/2007 | Baerlocher et al. |
| 7,172,506 | B2 | 2/2007 | Baerlocher et al. |
| 7,175,523 | B2 | 2/2007 | Gilmore et al. |
| 7,179,166 | B1 | 2/2007 | Abbott |
| 7,182,689 | B2 | 2/2007 | Hughs-Baird et al. |
| 7,198,570 | B2 | 4/2007 | Rodgers et al. |
| 7,198,571 | B2 | 4/2007 | LeMay et al. |
| 7,198,572 | B2 | 4/2007 | Walker et al. |
| 7,201,657 | B2 | 4/2007 | Baerlocher et al. |
| 7,204,428 | B2 | 4/2007 | Wilson |
| 7,223,172 | B2 | 5/2007 | Baerlocher et al. |
| 7,226,357 | B2 | 6/2007 | Vancura |
| 7,235,011 | B2 | 6/2007 | Randall et al. |
| 7,264,545 | B2 | 9/2007 | Maya et al. |
| 7,294,058 | B1 | 11/2007 | Slomiany et al. |
| 7,300,348 | B2 | 11/2007 | Kaminkow et al. |
| 7,303,469 | B2 | 12/2007 | Kaminkow et al. |
| 7,306,520 | B2 | 12/2007 | Kaminkow et al. |
| 7,311,598 | B2 | 12/2007 | Kaminkow et al. |
| 7,311,604 | B2 | 12/2007 | Kaminkow et al. |
| 7,314,408 | B2 | 1/2008 | Cannon |
| 7,314,409 | B2 | 1/2008 | Maya et al. |
| 7,318,773 | B2 | 1/2008 | Baerlocher |
| 7,326,115 | B2 | 2/2008 | Baerlocher |
| 7,329,179 | B2 | 2/2008 | Baerlocher |
| 7,329,184 | B2 | 2/2008 | Yoshioka |
| 7,331,868 | B2 | 2/2008 | Beaulieu et al. |
| 7,335,102 | B2 | 2/2008 | Baerlocher et al. |
| 7,338,367 | B2 | 3/2008 | Kaminkow et al. |
| 7,338,369 | B2 | 3/2008 | Mierau et al. |
| 7,351,140 | B2 | 4/2008 | Wolf et al. |
| 7,351,146 | B2 | 4/2008 | Kaminkow |
| 7,357,714 | B2 | 4/2008 | Tessmer et al. |
| 7,361,087 | B2 | 4/2008 | Baerlocher et al. |
| 7,374,486 | B2 | 5/2008 | Baerlocher |
| 7,387,571 | B2 | 6/2008 | Walker et al. |
| 7,393,280 | B2 | 7/2008 | Cannon |
| 7,397,464 | B1 | 7/2008 | Robbins et al. |
| 7,419,162 | B2 | 9/2008 | Lancaster et al. |
| 7,419,425 | B1 | 9/2008 | Crowder et al. |
| 7,427,235 | B2 | 9/2008 | Anderson et al. |
| 7,427,236 | B2 | 9/2008 | Kaminkow et al. |
| 7,448,949 | B2 | 11/2008 | Kaminkow et al. |
| 7,463,270 | B2 | 12/2008 | Vale et al. |
| 7,465,227 | B2 | 12/2008 | Baerlocher |
| 7,470,185 | B2 | 12/2008 | Baerlocher |
| 7,478,812 | B2 | 1/2009 | Sokolov |
| 7,479,949 | B2 | 1/2009 | Jobs et al. |
| 7,485,038 | B2 | 2/2009 | Rothkranz et al. |
| 7,488,251 | B2 | 2/2009 | Kaminkow |
| 7,500,913 | B2 | 3/2009 | Baerlocher |
| 7,507,156 | B2 | 3/2009 | Nicely |
| 7,513,825 | B2 | 4/2009 | Packes, Jr. et al. |

(56) References Cited

U.S. PATENT DOCUMENTS 7,568,973 B2 8/2009 Iddings et al.
7,585,223 B2 9/2009 Iddings et al.
7,597,621 B2 10/2009 Baerlocher
7,607,976 B2 10/2009 Baerlocher
7,637,811 B2 12/2009 Walker et al.
7,641,548 B2 1/2010 Packes, Jr. et al.
7,654,896 B2 2/2010 Baerlocher
7,666,081 B2 2/2010 Baerlocher et al.
7,666,092 B2 2/2010 Kaminkow et al.
7,666,093 B2 2/2010 Lafky et al.
7,666,094 B2 2/2010 Baerlocher et al.
7,674,180 B2 3/2010 Graham et al.
7,677,971 B2 3/2010 Baerlocher et al.
7,690,977 B2 4/2010 Cuddy et al.
7,695,358 B2 4/2010 Walker et al.
8,029,360 B2 10/2011 Lind et al.
8,047,909 B2 11/2011 Walker et al.
8,052,526 B2 11/2011 Abbott et al.
8,057,294 B2 11/2011 Pacey et al.
8,070,597 B2 12/2011 Cuddy
8,070,600 B2 12/2011 Campo et al.
8,100,760 B2 1/2012 Cannon
8,105,149 B2 1/2012 Dewaal
8,118,656 B2 2/2012 Hamada
8,118,664 B2 2/2012 Johnson
8,118,666 B2 2/2012 Nicely et al.
8,137,188 B2 3/2012 Breckner et al.
8,147,322 B2 4/2012 Walker et al.
8,157,646 B2 4/2012 Pawloski et al.
8,162,746 B2 4/2012 Nicely et al.
8,192,277 B2 6/2012 Soltys et al.
8,201,229 B2 6/2012 Ruppert et al.
8,210,937 B2 7/2012 Cregan et al.
8,231,448 B2 7/2012 Cuddy et al.
8,251,800 B2 8/2012 Cannon
8,251,803 B2 8/2012 Nelson
8,262,469 B2 9/2012 Iddings et al.
8,266,213 B2 9/2012 Crowder
8,267,797 B2 9/2012 Thomas et al.
8,287,364 B2 10/2012 Caputo et al.
8,298,063 B2 10/2012 Packes, Jr. et al.
8,313,368 B2 11/2012 Filipour et al.
8,328,626 B2 12/2012 Hornik
8,328,631 B2 12/2012 Baerlocher
8,328,633 B2 12/2012 Cohen et al.
8,328,635 B2 12/2012 Oosthoek
8,337,298 B2 12/2012 Baerlocher
8,342,932 B2 1/2013 Fleckenstein et al.
8,342,947 B2 1/2013 Baerlocher et al.
8,347,303 B2 1/2013 Singh et al.
8,348,749 B1 1/2013 Ungaro et al.
8,348,753 B2 1/2013 Low et al.
8,366,542 B2 2/2013 White et al.
8,371,931 B2 2/2013 Decasa et al.
8,376,836 B2 2/2013 Baerlocher et al.
8,376,839 B2 2/2013 Lesley et al.
8,382,584 B2 2/2013 White et al.
8,408,993 B2 4/2013 Lafky et al.
8,408,994 B2 4/2013 Baerlocher et al.
8,412,768 B2 4/2013 Rajaraman et al.
8,414,371 B2 4/2013 Tempest et al.
8,419,549 B2 4/2013 Kaminkow et al.
8,423,790 B2 4/2013 Atashband et al.
8,425,323 B2 * 4/2013 Fiden ..... G06Q 30/08 463/16
8,430,408 B2 4/2013 Baerlocher et al.
8,430,747 B2 4/2013 Kniesteadt et al.
8,439,739 B2 5/2013 Walker et al.
8,439,744 B2 5/2013 Englman et al.
8,439,756 B2 5/2013 Baerlocher et al.
8,444,480 B2 5/2013 Baerlocher et al.
8,449,366 B2 5/2013 Thomas
8,449,380 B2 5/2013 Baerlocher et al.
8,460,088 B1 * 6/2013 Shimizu ..... A63F 13/795 463/16
8,545,321 B2 10/2013 Baerlocher et al.
8,721,450 B2 5/2014 Walker et al.
2001/0000118 A1 4/2001 Sines et al.
2001/0000933 A1 5/2001 Koelling
2001/0003709 A1 6/2001 Adams
2001/0004606 A1 6/2001 Tracy et al.
2001/0018361 A1 8/2001 Acres
2001/0035610 A1 11/2001 Webb
2001/0054796 A1 12/2001 Lo
2002/0002075 A1 1/2002 Rowe
2002/0028710 A1 3/2002 Ishihara et al.
2002/0034974 A1 3/2002 Wood et al.
2002/0037765 A1 3/2002 Johnson
2002/0039921 A1 4/2002 Rowe et al.
2002/0042298 A1 4/2002 Soltys et al.
2002/0042299 A1 4/2002 Soltys et al.
2002/0045472 A1 4/2002 Adams
2002/0052232 A1 5/2002 Kaminkow
2002/0052234 A1 5/2002 Adams
2002/0055381 A1 5/2002 Tarantino
2002/0059252 A1 5/2002 Yamaguchi
2002/0068625 A1 6/2002 Soltys et al.
2002/0072405 A1 6/2002 Soltys et al.
2002/0072407 A1 6/2002 Soltys et al.
2002/0077167 A1 6/2002 Merari
2002/0077170 A1 6/2002 Johnson et al.
2002/0082076 A1 6/2002 Roser et al.
2002/0094855 A1 7/2002 Berman
2002/0107072 A1 8/2002 Giobbi
2002/0119824 A1 8/2002 Allen
2002/0140680 A1 10/2002 Lu
2002/0142825 A1 10/2002 Lark et al.
2002/0142826 A1 10/2002 Adams
2002/0142830 A1 10/2002 Adams
2002/0142846 A1 10/2002 Paulsen
2002/0147040 A1 10/2002 Walker et al.
2002/0151342 A1 10/2002 Tracy et al.
2002/0161645 A1 10/2002 Walker et al.
2002/0169017 A1 11/2002 Visoenik
2002/0177480 A1 11/2002 Rowe
2002/0177483 A1 11/2002 Cannon
2002/0185981 A1 12/2002 Dietz et al.
2002/0198036 A1 12/2002 Baerlocher et al.
2002/0198038 A1 12/2002 Adams
2003/0004871 A1 1/2003 Rowe
2003/0011127 A1 1/2003 Vancura et al.
2003/0013514 A1 1/2003 Cregan et al.
2003/0013520 A1 1/2003 Adams
2003/0020733 A1 1/2003 Yin
2003/0036422 A1 2/2003 Baerlocher et al.
2003/0036424 A1 2/2003 Baerlocher
2003/0040358 A1 2/2003 Rothkranz et al.
2003/0057648 A1 3/2003 Webb
2003/0060264 A1 3/2003 Chilton et al.
2003/0060266 A1 3/2003 Baerlocher
2003/0060277 A1 3/2003 Webb et al.
2003/0064772 A1 4/2003 Tempest et al.
2003/0064773 A1 4/2003 Baerlocher et al.
2003/0064785 A1 4/2003 Stone et al.
2003/0069064 A1 4/2003 Ainsworth
2003/0071418 A1 4/2003 Saucier
2003/0078096 A1 4/2003 Kaminkow et al.
2003/0087696 A1 5/2003 Soltys et al.
2003/0094752 A1 5/2003 Mathews
2003/0100361 A1 5/2003 Sharpless et al.
2003/0104854 A1 6/2003 Cannon
2003/0104860 A1 6/2003 Cannon et al.
2003/0104862 A1 6/2003 Acres
2003/0114216 A1 6/2003 Adams
2003/0114218 A1 6/2003 McClintic
2003/0114219 A1 6/2003 McClintic
2003/0114220 A1 6/2003 McClintic
2003/0119576 A1 6/2003 McClintic et al.
2003/0119581 A1 6/2003 Cannon et al.
2003/0125107 A1 7/2003 Cannon
2003/0130041 A1 7/2003 Pascal et al.
2003/0144053 A1 7/2003 Michaelson
2003/0151194 A1 8/2003 Hessing et al.
2003/0153378 A1 8/2003 Schlegel et al.

(56) References Cited

U.S. PATENT DOCUMENTS

| | | | |
|---|---|---|---|
| 2003/0157982 | A1 | 8/2003 | Gerrard et al. |
| 2003/0162578 | A1 | 8/2003 | Baerlocher et al. |
| 2003/0171142 | A1 | 9/2003 | Kaji et al. |
| 2003/0181231 | A1 | 9/2003 | Vancura et al. |
| 2003/0186733 | A1 | 10/2003 | Wolf et al. |
| 2003/0186745 | A1 | 10/2003 | Nguyen et al. |
| 2003/0207709 | A1 | 11/2003 | Paotrakul |
| 2003/0207710 | A1 | 11/2003 | Rodgers et al. |
| 2003/0211884 | A1 | 11/2003 | Gauselmann |
| 2003/0220138 | A1 | 11/2003 | Walker et al. |
| 2003/0228901 | A1 | 12/2003 | Walker et al. |
| 2003/0236116 | A1 | 12/2003 | Marks et al. |
| 2004/0029631 | A1 | 2/2004 | Duhamel |
| 2004/0033831 | A1 | 2/2004 | Tarantino |
| 2004/0038733 | A1 | 2/2004 | Walker et al. |
| 2004/0038734 | A1 | 2/2004 | Adams |
| 2004/0048644 | A1 | 3/2004 | Gerrard et al. |
| 2004/0048649 | A1 | 3/2004 | Peterson et al. |
| 2004/0048657 | A1 | 3/2004 | Gauselmann |
| 2004/0048659 | A1 | 3/2004 | Seelig et al. |
| 2004/0051240 | A1 | 3/2004 | Adams |
| 2004/0053661 | A1 | 3/2004 | Jones et al. |
| 2004/0053665 | A1 | 3/2004 | Baerlocher |
| 2004/0053673 | A1 | 3/2004 | Mishra |
| 2004/0053683 | A1 | 3/2004 | Hartl et al. |
| 2004/0063492 | A1 | 4/2004 | Baerlocher et al. |
| 2004/0070146 | A1 | 4/2004 | Snow |
| 2004/0072619 | A1 | 4/2004 | Brosnan et al. |
| 2004/0106444 | A1 | 6/2004 | Cuddy et al. |
| 2004/0106446 | A1 | 6/2004 | Cannon et al. |
| 2004/0127284 | A1 | 7/2004 | Walker et al. |
| 2004/0152509 | A1 | 8/2004 | Hornik et al. |
| 2004/0162130 | A1 | 8/2004 | Walker et al. |
| 2004/0164491 | A1 | 8/2004 | Webb |
| 2004/0166937 | A1 | 8/2004 | Rothschild et al. |
| 2004/0171416 | A1 | 9/2004 | Baerlocher et al. |
| 2004/0176156 | A1 | 9/2004 | Walker et al. |
| 2004/0183256 | A1 | 9/2004 | Ko |
| 2004/0195770 | A1 | 10/2004 | Ornstein |
| 2004/0198484 | A1 | 10/2004 | Johnson |
| 2004/0204218 | A1 | 10/2004 | Hughs-Baird |
| 2004/0204226 | A1 | 10/2004 | Foster et al. |
| 2004/0204235 | A1 | 10/2004 | Walker et al. |
| 2004/0224777 | A1 | 11/2004 | Smith et al. |
| 2004/0235552 | A1 | 11/2004 | Gauselmann |
| 2004/0242315 | A1 | 12/2004 | Paulsen et al. |
| 2004/0248639 | A1 | 12/2004 | Slomiany |
| 2004/0251630 | A1 | 12/2004 | Sines et al. |
| 2005/0009600 | A1 | 1/2005 | Rowe et al. |
| 2005/0012273 | A1 | 1/2005 | Bruno et al. |
| 2005/0020340 | A1 | 1/2005 | Cannon |
| 2005/0020351 | A1 | 1/2005 | Baerlocher et al. |
| 2005/0026680 | A1 | 2/2005 | Gururajan |
| 2005/0026683 | A1 | 2/2005 | Fujimoto |
| 2005/0029743 | A1 | 2/2005 | Daines |
| 2005/0032568 | A1 | 2/2005 | Griswold et al. |
| 2005/0033461 | A1 | 2/2005 | Gerrard et al. |
| 2005/0043088 | A1 | 2/2005 | Nguyen et al. |
| 2005/0043089 | A1 | 2/2005 | Nguyen et al. |
| 2005/0043094 | A1 | 2/2005 | Nguyen et al. |
| 2005/0051963 | A1 | 3/2005 | Snow |
| 2005/0054404 | A1 | 3/2005 | Baerlocher |
| 2005/0054405 | A1 | 3/2005 | Baerlocher et al. |
| 2005/0054408 | A1 | 3/2005 | Steil et al. |
| 2005/0054415 | A1 | 3/2005 | Kaminkow et al. |
| 2005/0054416 | A1 | 3/2005 | Hostetler et al. |
| 2005/0054429 | A1 | 3/2005 | Baerlocher et al. |
| 2005/0054435 | A1 | 3/2005 | Rodgers et al. |
| 2005/0054436 | A1 | 3/2005 | Frizzell et al. |
| 2005/0059456 | A1 | 3/2005 | Mead et al. |
| 2005/0059460 | A1 | 3/2005 | Breen et al. |
| 2005/0059461 | A1 | 3/2005 | Ching et al. |
| 2005/0059474 | A1 | 3/2005 | O'Halloran |
| 2005/0060050 | A1 | 3/2005 | Baerlocher |
| 2005/0064928 | A1 | 3/2005 | Baerlocher et al. |
| 2005/0073100 | A1 | 4/2005 | Falciglia, Sr. |
| 2005/0073102 | A1 | 4/2005 | Yoseloff et al. |
| 2005/0079911 | A1 | 4/2005 | Nakatsu |
| 2005/0082758 | A1 | 4/2005 | Sklansky et al. |
| 2005/0085294 | A1 | 4/2005 | Walker et al. |
| 2005/0096114 | A1 | 5/2005 | Cannon et al. |
| 2005/0096123 | A1 | 5/2005 | Cregan et al. |
| 2005/0101372 | A1 | 5/2005 | Mierau et al. |
| 2005/0101374 | A1 | 5/2005 | Acres |
| 2005/0101378 | A1 | 5/2005 | Kaminkow et al. |
| 2005/0101384 | A1 | 5/2005 | Parham |
| 2005/0116414 | A1 | 6/2005 | Yurkins |
| 2005/0119043 | A1 | 6/2005 | Berman et al. |
| 2005/0119047 | A1 | 6/2005 | Olive |
| 2005/0119048 | A1 | 6/2005 | Soltys et al. |
| 2005/0137014 | A1 | 6/2005 | Vetelainen |
| 2005/0143168 | A1 | 6/2005 | Torango |
| 2005/0161882 | A1 | 7/2005 | Miller |
| 2005/0162402 | A1 | 7/2005 | Watanachote |
| 2005/0164759 | A1 | 7/2005 | Smith et al. |
| 2005/0164760 | A1 | 7/2005 | Moody |
| 2005/0176488 | A1 | 8/2005 | Olive |
| 2005/0178074 | A1 | 8/2005 | Kerosetz |
| 2005/0181860 | A1 | 8/2005 | Nguyen et al. |
| 2005/0192081 | A1 | 9/2005 | Marks et al. |
| 2005/0197180 | A1 | 9/2005 | Kaminkow et al. |
| 2005/0209004 | A1 | 9/2005 | Torango |
| 2005/0215307 | A1 | 9/2005 | Jarvis et al. |
| 2005/0218590 | A1 | 10/2005 | O'Halloran et al. |
| 2005/0218591 | A1 | 10/2005 | Torigian et al. |
| 2005/0227771 | A1 | 10/2005 | Nelson et al. |
| 2005/0233803 | A1 | 10/2005 | Yang |
| 2005/0239542 | A1 | 10/2005 | Olsen |
| 2005/0245302 | A1 | 11/2005 | Bathiche et al. |
| 2005/0251800 | A1 | 11/2005 | Kurlander et al. |
| 2005/0269776 | A1 | 12/2005 | Miller |
| 2005/0282622 | A1 | 12/2005 | Lindquist |
| 2005/0282625 | A1 | 12/2005 | Nicely |
| 2005/0282626 | A1 | 12/2005 | Manfredi et al. |
| 2006/0001211 | A1 | 1/2006 | Lewis et al. |
| 2006/0009283 | A1 | 1/2006 | Englman et al. |
| 2006/0019739 | A1 | 1/2006 | Soltys et al. |
| 2006/0022956 | A1 | 2/2006 | Lengeling et al. |
| 2006/0025195 | A1 | 2/2006 | Pennington et al. |
| 2006/0026521 | A1 | 2/2006 | Hotelling et al. |
| 2006/0030394 | A1 | 2/2006 | Crivelli et al. |
| 2006/0030399 | A1 | 2/2006 | Baerlocher |
| 2006/0030401 | A1 | 2/2006 | Mead et al. |
| 2006/0030959 | A1 | 2/2006 | Duhamel |
| 2006/0030960 | A1 | 2/2006 | Duhamel et al. |
| 2006/0032680 | A1 | 2/2006 | Elias et al. |
| 2006/0040723 | A1 | 2/2006 | Baerlocher et al. |
| 2006/0040732 | A1 | 2/2006 | Baerlocher et al. |
| 2006/0040733 | A1 | 2/2006 | Baerlocher et al. |
| 2006/0040734 | A1 | 2/2006 | Baerlocher et al. |
| 2006/0040736 | A1 | 2/2006 | Baerlocher et al. |
| 2006/0046821 | A1 | 3/2006 | Kaminkow et al. |
| 2006/0046822 | A1 | 3/2006 | Kaminkow et al. |
| 2006/0046849 | A1 | 3/2006 | Kovacs et al. |
| 2006/0052885 | A1 | 3/2006 | Kong |
| 2006/0058088 | A1 | 3/2006 | Crawford, III et al. |
| 2006/0066564 | A1 | 3/2006 | Yee et al. |
| 2006/0068864 | A1 | 3/2006 | White et al. |
| 2006/0068870 | A1 | 3/2006 | Crawford, III et al. |
| 2006/0068882 | A1 | 3/2006 | Baerlocher et al. |
| 2006/0068893 | A1 | 3/2006 | Jaffe et al. |
| 2006/0069619 | A1 | 3/2006 | Walker et al. |
| 2006/0073868 | A1 | 4/2006 | Nordman |
| 2006/0073874 | A1 | 4/2006 | Cregan et al. |
| 2006/0082056 | A1 | 4/2006 | Kane et al. |
| 2006/0084500 | A1 | 4/2006 | Baerlocher et al. |
| 2006/0086896 | A1 | 4/2006 | Han |
| 2006/0097991 | A1 | 5/2006 | Hotelling et al. |
| 2006/0105836 | A1 | 5/2006 | Walker et al. |
| 2006/0125803 | A1 | 6/2006 | Westerman et al. |
| 2006/0128457 | A1 | 6/2006 | Cannon |
| 2006/0135238 | A1 | 6/2006 | Lancaster et al. |
| 2006/0148565 | A1 | 7/2006 | Gauselmann et al. |
| 2006/0157928 | A1 | 7/2006 | O'Halloran |

(56) References Cited

U.S. PATENT DOCUMENTS

2006/0170154 A1 8/2006 Matsuno et al.
2006/0170155 A1 8/2006 Silverman
2006/0177109 A1 8/2006 Storch
2006/0183528 A1 8/2006 Rodgers et al.
2006/0197750 A1 9/2006 Kerr et al.
2006/0197753 A1 9/2006 Hotelling
2006/0199628 A1 9/2006 Rodgers et al.
2006/0217189 A1 9/2006 Walker et al.
2006/0237905 A1 10/2006 Nicely et al.
2006/0238517 A1 10/2006 King et al.
2006/0238518 A1 10/2006 Westerman et al.
2006/0238519 A1 10/2006 Westerman et al.
2006/0238520 A1 10/2006 Westerman et al.
2006/0238521 A1 10/2006 Westerman et al.
2006/0238522 A1 10/2006 Westerman et al.
2006/0240887 A1 10/2006 Walker et al.
2006/0246977 A1 11/2006 Cannon
2006/0247955 A1 11/2006 Humphrey
2006/0249899 A1 11/2006 Lease
2006/0252518 A1 11/2006 Walker et al.
2006/0284874 A1 12/2006 Wilson
2006/0287053 A1 12/2006 Yokota
2007/0015566 A1 1/2007 Baerlocher et al.
2007/0021198 A1 1/2007 Muir
2007/0032285 A1 2/2007 Wolf
2007/0045958 A1 3/2007 Rader et al.
2007/0054726 A1 3/2007 Muir et al.
2007/0054732 A1 3/2007 Baerlocher
2007/0054733 A1 3/2007 Baerlocher
2007/0060271 A1 3/2007 Cregan et al.
2007/0060300 A1 3/2007 Baerlocher
2007/0060321 A1 3/2007 Vasquez et al.
2007/0069459 A1 3/2007 Guindulain
2007/0070050 A1 3/2007 Westerman et al.
2007/0070051 A1 3/2007 Westerman et al.
2007/0070052 A1 3/2007 Westerman et al.
2007/0075488 A1 4/2007 Pececnik
2007/0077990 A1 4/2007 Cuddy et al.
2007/0078919 A1 4/2007 Westerman et al.
2007/0081726 A1 4/2007 Westerman et al.
2007/0082725 A1 4/2007 Low et al.
2007/0087809 A1 4/2007 Baerlocher
2007/0105620 A1 5/2007 Cuddy et al.
2007/0111783 A1 5/2007 Cuddy et al.
2007/0117606 A1 5/2007 Baerlocher et al.
2007/0117608 A1 5/2007 Roper et al.
2007/0120320 A1 5/2007 Miltenberger et al.
2007/0129131 A1 6/2007 Kaminkow et al.
2007/0135203 A1 6/2007 Nicely
2007/0135204 A1 6/2007 Nicely
2007/0139395 A1 6/2007 Westerman et al.
2007/0146336 A1 6/2007 Ording et al.
2007/0149269 A1 6/2007 Benbrahim
2007/0152980 A1 7/2007 Kocienda et al.
2007/0152984 A1 7/2007 Ording et al.
2007/0155464 A1 7/2007 Baerlocher et al.
2007/0155481 A1 7/2007 Vancura
2007/0155485 A1 7/2007 Cuddy et al.
2007/0157089 A1 7/2007 Van Os et al.
2007/0167206 A1 7/2007 Kirkutis
2007/0167211 A1 7/2007 Rodgers et al.
2007/0167217 A1 7/2007 Kaminkow et al.
2007/0167229 A1 7/2007 LeMay et al.
2007/0177803 A1 8/2007 Elias et al.
2007/0177804 A1 8/2007 Elias et al.
2007/0188444 A1 8/2007 Vale et al.
2007/0192550 A1 8/2007 Rodeheffer et al.
2007/0213119 A1 9/2007 Baerlocher et al.
2008/0015006 A1 1/2008 George et al.
2008/0020815 A1 1/2008 Lancaster et al.
2008/0020817 A1 1/2008 Kaminkow et al.
2008/0020822 A1 1/2008 Cuddy et al.
2008/0020823 A1 1/2008 Cuddy et al.
2008/0020824 A1 1/2008 Cuddy et al.
2008/0020825 A1 1/2008 Cuddy et al.
2008/0020829 A1 1/2008 Baerlocher
2008/0020842 A1 1/2008 Kaminkow et al.
2008/0020847 A1 1/2008 Kniesteadt et al.
2008/0026808 A1 1/2008 Yoshizawa
2008/0026813 A1 1/2008 Cannon
2008/0051168 A1 2/2008 Kaminkow et al.
2008/0051188 A1 2/2008 Inamura
2008/0058046 A1 3/2008 Schwartz et al.
2008/0070662 A1 3/2008 Verardi et al.
2008/0070674 A1 3/2008 Lancaster et al.
2008/0070676 A1 3/2008 Baerlocher et al.
2008/0070677 A1 3/2008 Baerlocher et al.
2008/0070678 A1 3/2008 Baerlocher et al.
2008/0070702 A1 3/2008 Kaminkow et al.
2008/0076500 A1 3/2008 Lancaster et al.
2008/0076581 A1 3/2008 Mattice et al.
2008/0081690 A1 4/2008 Baerlocher et al.
2008/0081691 A1 4/2008 Baerlocher et al.
2008/0090651 A1 4/2008 Baerlocher
2008/0102916 A1 5/2008 Kovacs et al.
2008/0102920 A1 5/2008 Baerlocher
2008/0102934 A1 5/2008 Tan
2008/0108401 A1 5/2008 Baerlocher et al.
2008/0108406 A1 5/2008 Oberberger
2008/0108425 A1 5/2008 Oberberger
2008/0108429 A1 5/2008 Davis et al.
2008/0113759 A1 5/2008 Baerlocher
2008/0113765 A1 5/2008 DeWaal
2008/0113768 A1 5/2008 Baerlocher
2008/0113771 A1 5/2008 Baerlocher et al.
2008/0122803 A1 5/2008 Izadi et al.
2008/0132320 A1 6/2008 Rodgers
2008/0139274 A1 6/2008 Baerlocher
2008/0139290 A1 6/2008 Kniesteadt et al.
2008/0149292 A1 6/2008 Scherb
2008/0153564 A1 6/2008 Baerlocher et al.
2008/0176650 A1 7/2008 Wolf et al.
2008/0182650 A1 7/2008 Randall et al.
2008/0182655 A1 7/2008 DeWaal et al.
2008/0194316 A1 8/2008 Baerlocher
2008/0214280 A1 9/2008 Baerlocher
2008/0274788 A1 11/2008 Wilson
2008/0311979 A1 12/2008 Walker et al.
2008/0318668 A1 12/2008 Ching et al.
2009/0042644 A1 2/2009 Zielinski
2009/0115133 A1* 5/2009 Kelly ..... A63F 3/00643 273/274
2009/0117994 A1 5/2009 Kelly et al.
2009/0118005 A1 5/2009 Kelly et al.
2009/0124327 A1 5/2009 Caputo et al.
2009/0124379 A1 5/2009 Wells
2009/0124383 A1 5/2009 Gadda et al.
2009/0143141 A1 6/2009 Wells et al.
2009/0244015 A1* 10/2009 Sengupta ..... G06F 3/04883 345/173
2009/0325686 A1 12/2009 Davis et al.
2010/0087241 A1 4/2010 Nguyen et al.
2010/0130280 A1 5/2010 Arezina et al.
2011/0065513 A1 3/2011 Nordahl et al.
2013/0328786 A1* 12/2013 Hinckley ..... G06F 3/033 345/173

FOREIGN PATENT DOCUMENTS

EP 0956111 11/1999
EP 0981119 2/2000
EP 0984408 3/2000
EP 0984409 3/2000
EP 1186329 3/2002
EP 1199689 4/2002
EP 1226851 7/2002
EP 1298607 4/2003
EP 1469432 4/2004
EP 1513116 3/2005
EP 1531434 5/2005
EP 1624421 2/2006
EP 1671684 6/2006
EP 1710000 10/2006
EP 1721642 11/2006

(56) References Cited

FOREIGN PATENT DOCUMENTS

| | | |
|---|---|---|
| EP | 1736215 | 12/2006 |
| EP | 1764753 | 3/2007 |
| EP | 1769828 | 4/2007 |
| EP | 1779908 | 5/2007 |
| GB | 2096376 | 10/1982 |
| GB | 2097160 | 10/1982 |
| GB | 2100905 | 1/1983 |
| GB | 2117952 | 10/1983 |
| GB | 2137392 | 10/1984 |
| GB | 2142457 | 1/1985 |
| GB | 2153572 | 8/1985 |
| GB | 2161008 | 1/1986 |
| GB | 2161009 | 1/1986 |
| GB | 2170636 | 8/1986 |
| GB | 2180682 | 4/1987 |
| GB | 2181589 | 4/1987 |
| GB | 2183882 | 6/1987 |
| GB | 2191030 | 12/1987 |
| GB | 2222712 | 3/1990 |
| GB | 2226907 | 7/1990 |
| GB | 2322217 | 12/1997 |
| GB | 2341262 | 3/2000 |
| GB | 2358591 | 8/2001 |
| GB | 2113881 | 8/2003 |
| GB | 2395139 | 5/2004 |
| GB | 2408951 | 6/2005 |
| GB | 2431362 | 4/2007 |
| JP | 09108431 | 4/1997 |
| JP | 2005211384 | 8/2005 |
| NZ | 0521900 | 8/1996 |
| WO | WO 9625208 | 8/1996 |
| WO | WO 9625725 | 8/1996 |
| WO | WO 1997032285 | 9/1997 |
| WO | WO 9738366 | 10/1997 |
| WO | WO 9738766 | 10/1997 |
| WO | WO 9800210 | 1/1998 |
| WO | WO 9847115 | 10/1998 |
| WO | WO 9851384 | 11/1998 |
| WO | WO 9903078 | 1/1999 |
| WO | WO 2000012186 | 3/2000 |
| WO | WO 0033269 | 6/2000 |
| WO | WO 0125957 | 4/2001 |
| WO | WO 0174464 | 10/2001 |
| WO | WO 0217250 | 2/2002 |
| WO | WO 03013673 | 2/2003 |
| WO | WO 03025867 | 3/2003 |
| WO | WO 03026381 | 4/2003 |
| WO | WO 2003026759 | 4/2003 |
| WO | WO 2003049053 | 6/2003 |
| WO | WO 2004021294 | 3/2004 |
| WO | WO 2004112923 | 12/2004 |
| WO | WO 2005002697 | 1/2005 |
| WO | WO 2005009563 | 2/2005 |
| WO | WO 2005015826 | 2/2005 |
| WO | WO 2005025696 | 3/2005 |
| WO | WO 2005025701 | 3/2005 |
| WO | WO 2005037385 | 4/2005 |
| WO | WO 2005081958 | 9/2005 |
| WO | WO 2005083599 | 9/2005 |
| WO | WO 2005094954 | 10/2005 |
| WO | WO 2005099425 | 10/2005 |
| WO | WO 2005123203 | 12/2005 |
| WO | WO 2006015442 | 2/2006 |
| WO | WO 2006017067 | 2/2006 |
| WO | WO 2006017068 | 2/2006 |
| WO | WO 2006041765 | 4/2006 |
| WO | WO 2006061616 | 6/2006 |
| WO | WO 2006078219 | 7/2006 |
| WO | WO 2006088498 | 8/2006 |
| WO | WO 2006094398 | 9/2006 |
| WO | WO 2006097007 | 9/2006 |
| WO | WO 2006121663 | 11/2006 |
| WO | WO 2007021724 | 2/2007 |
| WO | WO 2007024202 | 3/2007 |
| WO | WO 2007033430 | 3/2007 |
| WO | WO 2007052549 | 5/2007 |
| WO | WO 2007077449 | 7/2007 |
| WO | WO 2007082336 | 7/2007 |
| WO | WO 2008045398 | 4/2008 |
| WO | WO 2008045464 | 4/2008 |

* cited by examiner

MULTIPLE PLAYER GAMING STATION INTERACTION SYSTEMS AND METHODS

PRIORITY CLAIM

This application is a non-provisional of, claims the benefit of and priority to U.S. Provisional Patent Application No. 61/939,531, filed on Feb. 13, 2014, the entire contents of which are incorporated herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Casinos and gaming venues typically offer patrons gameplay on electronic gaming machines ("EGMs") (e.g., slot machines, video poker machines, video keno machines, etc.) and game tables (e.g., poker tables, craps tables, blackjack tables, etc.). Many games offered at the casinos and gaming venues are individual, single-player games, in which players of one game do not have the ability to interact with players of another game. For example, a first patron playing a video slot game on a first EGM may not be able to interact with a second patron playing a video poker game on a second, adjacent EGM. Some games offered at the casinos and gaming venues are community or multiplayer games, such as poker, craps, and the like. In these multiplayer games, patron interaction typically occurs verbally (e.g., one patron speaking to another) or physically (e.g., one patron passing an object to a second patron).

SUMMARY

An exemplary embodiment of the present disclosure relates to a method of transferring an object in a gaming system including a first gaming machine and a second gaming machine, wherein the object is transferred from a first player at the first gaming machine to a second player at the second gaming machine. The method includes receiving, via a first touchscreen of the first gaming machine, a selection of an object by the first player. The method further includes receiving, via the first touchscreen, gesture information relating to the object. The method includes analyzing, by a controller of the gaming system, the gesture information. The method further includes determining, by the controller, that the object is to be transferred from the first player to the second player based at least in part on the gesture information. The method includes transferring, by the controller, the object from the first gaming machine to the second gaming machine.

Another exemplary embodiment relates to a method of transferring an object from a first player at a gaming table to a second player at the gaming table, wherein the first player is using a first playing station of the gaming table and the second player is using as second playing station of the gaming table, wherein each of the first and second playing stations includes a touchscreen display. The method includes receiving, via a first touchscreen of the first playing station, a selection of an object by the first player. The method further includes receiving, via the first touchscreen, gesture information relating to the object. The method includes analyzing, by a processor of the gaming table, the gesture information. The method further includes determining, by the processor, that the object is to be transferred from the first player to the second player based at least in part on the gesture information. The method includes transferring, by the controller, the object from the first gaming machine to the second gaming machine.

A further exemplary embodiment relates to a gaming table. The gaming table includes a game table surface and a plurality of player stations positioned about a periphery of the game table surface. The gaming table further includes a controller. The controller is configured to receive a selection of an object by a player from a first player station of the plurality of player stations. The controller is further configured to receive, from the first player station, gesture information relating to the object. The controller is configured to analyze the gesture information. The controller is further configured to determine that the object is to be transferred from the first player station to a second player station of the plurality of player stations based at least in part on the gesture information. The controller is configured to transfer the object from the first gaming machine to the second gaming machine.

BRIEF DESCRIPTION OF THE FIGURES

The details of one or more implementations are set forth in the accompanying drawings and the description below. Other features, aspects, and advantages of the disclosure will become apparent from the descriptions, the drawings, and the claims, in which:

DETAILED DESCRIPTION

Numerous specific details may be set forth below to provide a thorough understanding of concepts underlying the described implementations. It may be apparent, however, to one skilled in the art that the described implementations may be practiced without some or all of these specific details. In other instances, some process steps have not been described in detail in order to avoid unnecessarily obscuring the underlying concept.

The present disclosure relates to systems and methods for enabling players of games to interact with one another during game play of a game through graphical user interfaces of EGMs or smart game tables. The game may be a wager-based game. The player interactions may be related to gameplay of the game. For example, the player interactions may involve the passing of dice, chips, cards, or other game play elements between players. In other arrangements, the player interactions may be unrelated to gameplay of the game. For example, the player interactions may relate to the passing of messages, drink or food vouchers, video clips from a news feed, or the like between players. The player interactions may take place across different types of games. For example, a first player that is playing a video slot machine may pass a drink voucher to a second player that is playing an unrelated video poker game.

Generally, players may facilitate the interactions and object sharing by providing gestures, such as a swiping motion or a drag and drop motion, to a touchscreen of an EGM or a smart game table. The gaming system may determine the destination of the object based on a swipe speed, swipe direction, touch pressure, and object characteristics (e.g., object size, object weight, etc.). A physics engine may be utilized by the gaming system to determine an object trajectory and an object destination. The gaming system may be programmed with an accurate spatial model of the relative location of networked EGMs and player stations of smart game tables or receive real-time spatial information to assist with determining the proper destination of a shared object. The object may be a visual representation of a physical object that also carries an intangible characteristic that is transferred from the sending player to the receiving player. For example, the object may be a visual representation of a casino chip having a worth of a credit value or a visual representation of a complimentary drink value having a worth or a complimentary drink that is debited from the sending player's account and credited to the receiving player's account. Accordingly, the receiving player not only receives a visual icon of a transferred object, but the receiving player may also receive the intangible object represented by the visual icon.

Figure 1:
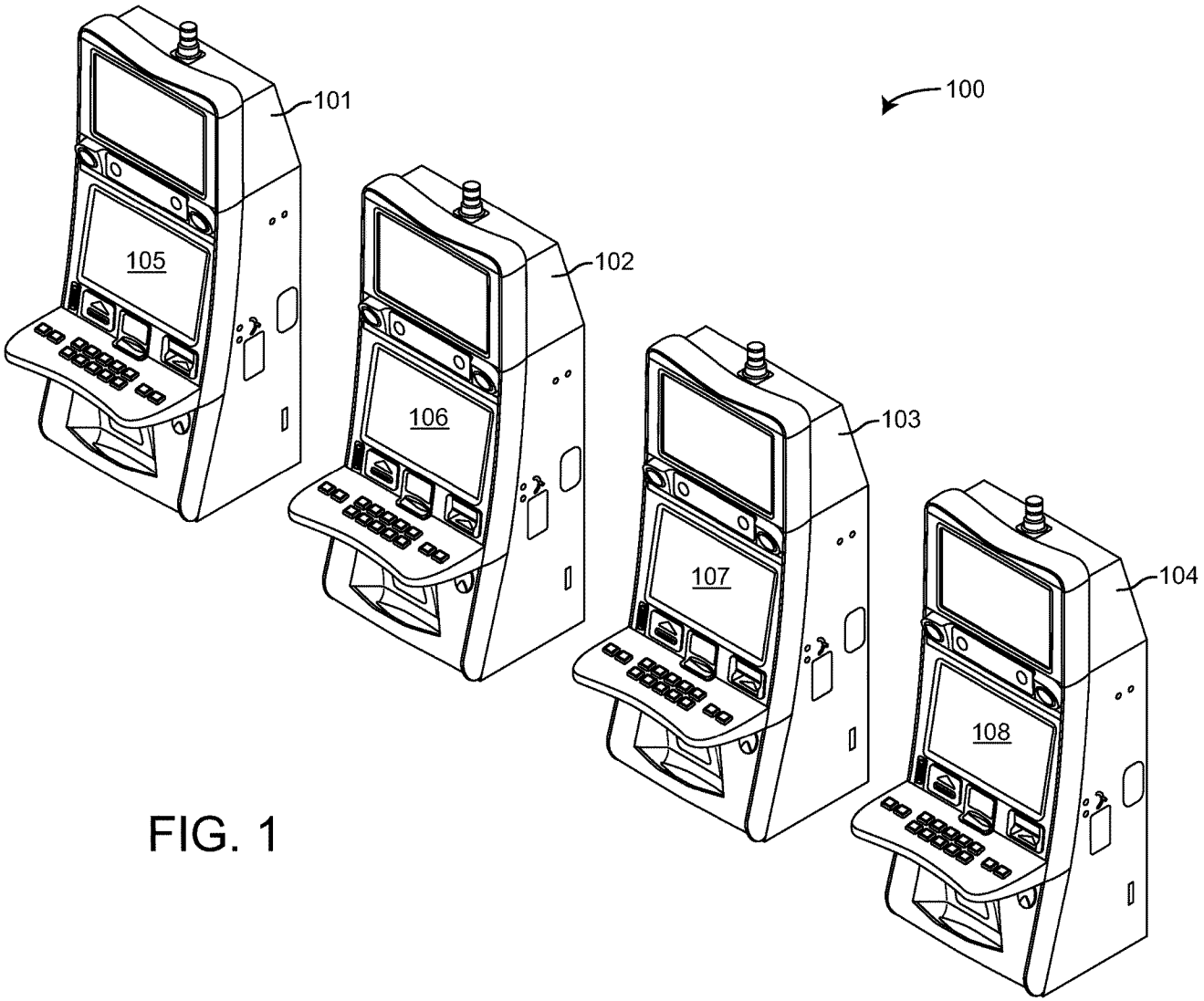
FIG. 1 is a row of EGMs shown according to an exemplary embodiment.

Referring to FIG. 1, a row of EGMs 100 is shown according to an exemplary embodiment. The row of EGMs 100 includes a first EGM 101, a second EGM 102, a third EGM 103, and a fourth EGM 104. Each EGM 101, 102, 103, and 104 includes a respective main display 105, 106, 107, and 108. The main displays 105, 106, 107, and 108 may be touchscreen displays configured to receive player input. The touchscreens may be resistive touchscreens, surface acoustic wave touchscreens, capacitive touchscreens, infrared touch screens, or another suitable touchscreen technology. The row of EGMs 100 may be networked with each other and/or with at least one gaming server. Each EGM 101, 102, 103, and 104 may offer gameplay of a single game or a variety of user-selectable games. The game may be a single-player game or a communal game. As described below with respect to FIG. 2 and FIG. 3, players of EGMs 101, 102, 103, and 104 can share objects with other players of those EGMs.

Figure 2:
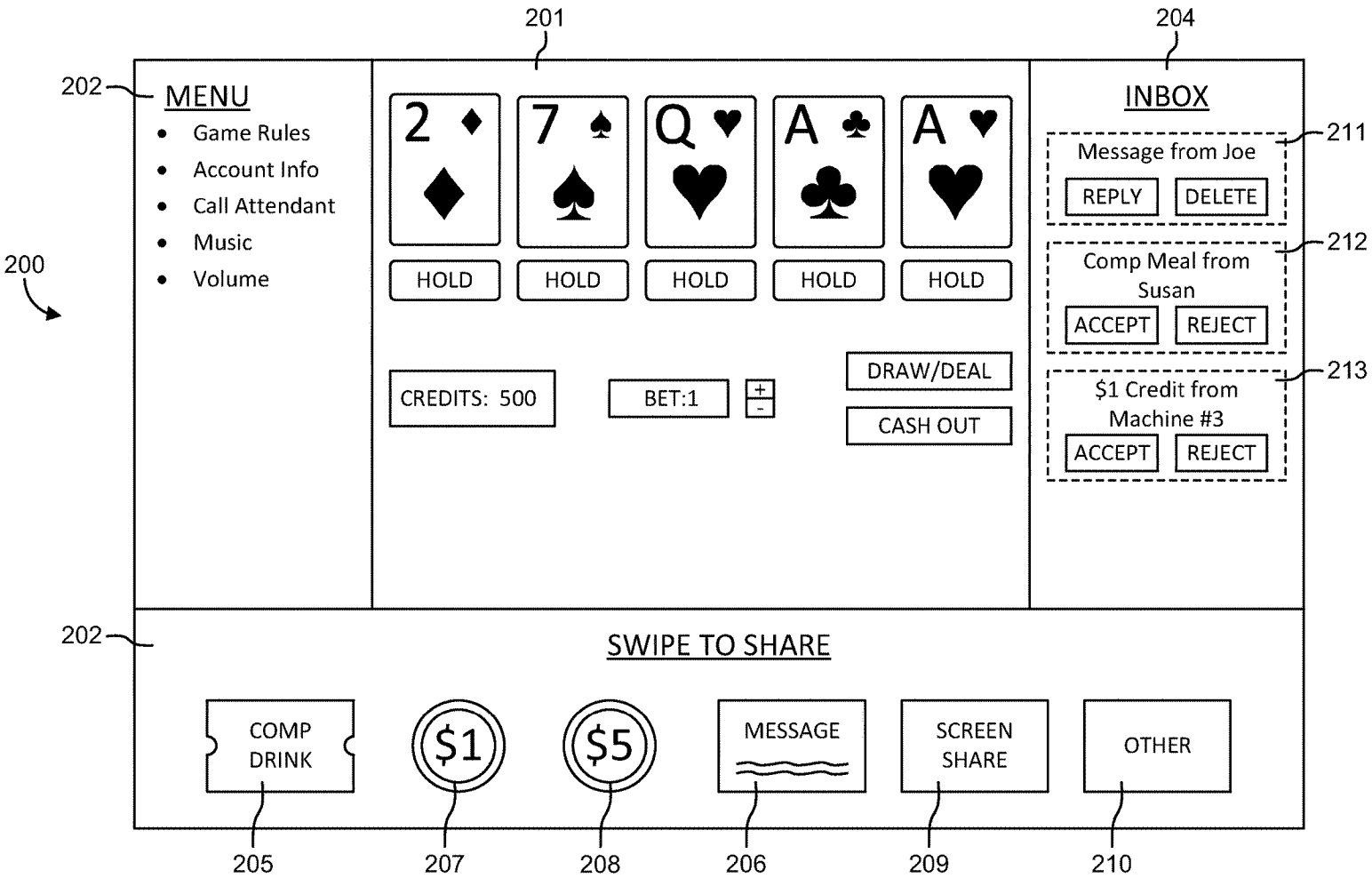
FIG. 2 is a graphical user interface shown according to an exemplary embodiment.

Referring to FIG. 2, a graphical user interface 200 is shown according to an exemplary embodiment. User interface 200 may be presented on any of displays 105, 106, 107, and 108. User interface 200 is interactive, meaning a player can provide input to the respective EGM by touching objects on the user interface 200. User interface 200 may be divided into a plurality of areas. User interface 200 may include a main gameplay area 201. In the gameplay area 201, the player of the respective EGM can play a game offered for play at the EGM. User interface 200 may include a menu area 202. In the menu area 202, the player can perform various tasks, such as viewing gameplay rules, checking player loyalty account status, calling a game attendant, adjusting a volume of the EGM, selecting music for playback on the EGM, and the like. User interface 200 includes an object sharing area 203. As discussed below, in the object sharing area 203, the player can share his items with other players on other EGMs. As discussed below, user interface 200 includes an inbox 204. In inbox 204, the player can view objects shared by other players.

Share area 203 presents the player various objects that the player can share with other players of nearby EGMs. The objects may be non-gaming related objects. For example, the object may be a complimentary drink or meal voucher (e.g., object 205), a message (e.g., object 206), a link to a news article, a video clip, etc. The objects may relate to gaming related objects. For example, the object may be a number of gaming credits (e.g., object 207 and object 208), a screenshot of the player's gameplay area 201 (e.g., object 209), a card or game object in a communal game (e.g., a card in hearts that is passed from one player's hand to another player's hand), an intra-bet proposition between two players, an invitation to join a group bonus event, etc. The gaming system may prepopulate the share area 203 with shareable objects. As shown in FIG. 2, the share area 203 is prepopulated with a complimentary drink ticket voucher 205, a $1 credit 207, a $5 credit 208, a message 206, and a screenshot share 209. If the player wishes to share an object that is not prepopulated (e.g., a news article), the player can view other shareable objects by interacting with the other button 210.

To share an object, the player interacts with the graphical user interface 200 by selecting the object and swiping the object in the direction of the recipient. For example, referring to FIG. 1, if the player is sitting at gaming machine 102 and wishes to share an object with a player sitting at gaming machine 101, the player will select the object, and swipe the object to the left. As an additional example, referring to FIG. 1, if the same player sitting at gaming machine 102 wishes to share an object with a player sitting at gaming machine 103, the player will select the object and swipe the object to the right. The gaming system receives information relating to the player's swiping motion of a selected object (e.g., swipe direction, swipe speed, contact pressure between the player's finger and the touchscreen, object characteristics, etc.), analyzes the information relating to the player's swiping motion, and determines a proper destination of the shared object. Accordingly, the gaming system may be programmed to be spatially aware of the layout of EGMs within the gaming system. Alternatively, the gaming system may receive real-time spatial information relating to the relative positions and orientations of the EGMs (e.g., via GPS, via IR beacons, via wireless triangulation, etc.). Based at least in part on the spatial relationships between various EGMs and the information relating to the player's swiping motion, the gaming system determines the appropriate destination of the object. The gaming system may employ a physics engine to assist with the destination determination. The destination determination may be made locally by a controller of the EGM or remotely by a controller of a gaming server connected to the EGMs.

As discussed in the example above, the player may swipe an object in a direction having multiple possible destinations (e.g., when the player swipes right from EGM 102 to EGM 103, EGM 104 is also positioned to the right of EGM 102). The gaming system may determine the proper destination through analysis of the spatial relationships between various EGMs and the information relating to the player's swiping motion. For example, if the player at EGM 102 initiates a slow swipe, the gaming system may determine that the destination EGM is EGM 103. If the player at EGM 102 initiates a fast swipe, the gaming system may determine that the destination EGM is EGM 104. The player's swipe speed may be determined against a standard swipe speed programmed into the gaming system.

In certain situations, the determined destination of a shared object may not be the intended destination of the shared object. Accordingly, the gaming system may present a confirmation message to the sending player via graphical user interface 200 prior to completing the sharing transaction. For example, after a player selects and swipes a complimentary drink voucher, the system may prompt the user with a message "Are you sure that you want to send the player two machines to your right a complimentary drink voucher?" The message may include options to confirm the transaction, to cancel the transaction, or to manually select a different recipient. If the system receives an indication that the player elects to manually select a different recipient, the system may present the player a visual representation of a floor plan of an area of the gaming floor including nearby EGMs. The player may then select a specific EGM as the recipient to complete the transaction.

Some shared objects require an intermediate step between the user's selection of the object and the sending of the object to the destination. For example, if a player wishes to send a message to another player and selects the message object 206, the graphical user interface 200 may present the user a message composition screen and an onscreen keyboard to compose the message prior to sending the message. As an additional example, a player may select to share a different amount of game credits than the prepopulated amount (i.e., a different amount than the $1 credit 207 or the $5 credit 208). Accordingly, the player may be prompted to enter an amount prior to sending the amount to another player.

Some transferrable objects include both a visual representation and an intangible characteristic. For example, if the sending player wishes to transfer a number of credits from his account to another player's account, the sending player will send a visual representation of the credits (e.g., an icon of a casino chip). Upon sending the icon to the receiving player, the sending player's account may be debited the value amount of the sent casino chip, and the receiving player's account may be credited the value amount. Other examples of transferrable objects having both a visual representation and an intangible characteristic include complimentary drink vouchers (e.g., a visual representation of a certificate having an intangible characteristic of a complimentary drink that may be debited and credited from player accounts), complimentary meal vouchers (e.g., a visual representation of a certificate having an intangible characteristic of a complimentary meal that may be debited and credited from player accounts), concert tickets (e.g., a visual representation of a certificate having an intangible characteristic of a concert ticket that may be debited and credited from player accounts), social media friend requests and contact shares (e.g., a visual representation of a player having an intangible characteristic of contact information or player account information that may be stored to the receiving player's account), and the like.

Still referring to FIG. 2, the graphical user interface 200 includes an inbox 204. Inbox 204 presents received objects from other players. For example, the player utilizing graphical user interface 200 has a received message 211, a received complimentary meal voucher 212, and a received $1 credit 213. Each received item in the inbox 204 may include an indication of the sender of the object. In some cases, the sender's identity may be known if the sender is signed into a player account (e.g., a casino loyalty account) at the EGM used to send the object. In other cases, the sender's identity may not be known. In such a situation, the gaming system may indicate to the player that the sender is located at a specific identified EGM (e.g., by indicating at least one of the location and identity of the sender's EGM). Through the inbox area 204, the player can reply to received messages, delete received messages, accept received objects, and reject received objects. If a user rejects a received object, the system returns the object to the sender. For example, if a recipient rejects a received $1 credit, the $1 credit is returned to the sending player's remaining credit balance.

Figure 3:
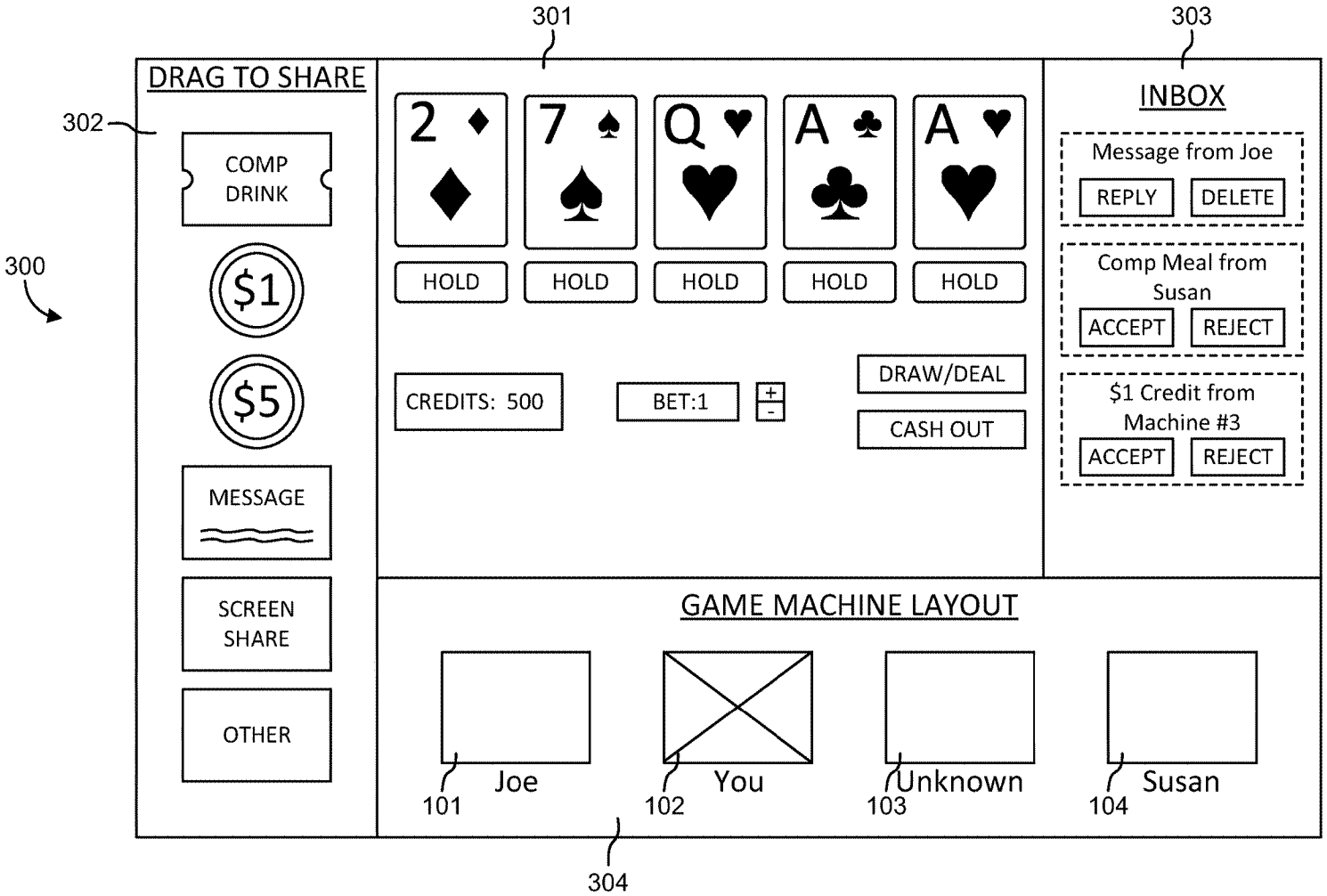
FIG. 3 is a graphical user interface shown according to an exemplary embodiment.

Referring to FIG. 3, a graphical user interface 300 is shown according to an exemplary embodiment. User interface 300 is similar to user interface 200 in that user interface 300 enables a player of a first EGM to share an object with a player of a second EGM. User interface 300 may be presented on any of displays 105, 106, 107, and 108. User interface 300 is interactive, meaning a player can provide input to the respective EGM by touching objects on the user interface 300. User interface 300 may be divided into a plurality of areas. User interface 300 may include a main gameplay area 301. In the gameplay area 301, the player of the respective EGM can play a game offered for play at the EGM. User interface 300 includes an object sharing area 302 that provides the user a list of objects that can be shared with players of other EGMs. The objects available to the player to share may be the same objects discussed above with respect to user interface 200. User interface 300 includes an inbox 303. In inbox 303, the player can view objects shared by other players, reject the shared objects, delete shared objects (e.g., delete a received message), and reply to shared objects (e.g., reply to a received message) in a similar manner as discussed above with respect to inbox 204. User interface 300 also includes an EGM layout area 304

User interface 300 enables players to share objects in a different manner than user interface 200. Unlike user interface 200, players utilizing user interface 300 do not select and swipe an object to share the object. Instead, user interface 300 facilitates the sharing of objects by presenting the player a graphical representation of available EGMs to share objects with in EGM layout area 304. EGM layout area 304 presents the player a floor plan of EGMs near the player. The floor plan may be spatially accurate with the actual layout of EGMs on the gaming floor. As shown in FIG. 3, the EGM layout area 304 shows the layout of EGMs presented in FIG. 1. The player using user interface 300 is using EGM 102. EGM 101 is occupied by Joe; EGM 103 is occupied by an unknown player; and EGM 104 is occupied by Susan. The names of the players occupying the specific EGMs may be displayed by user interface 300 if the gaming system knows the names of the player (e.g., if the player is logged into his or her player loyalty account). As shown, EGM 102 is crossed-off, indicating that the player cannot share objects with EGM 102 (since the player is already using EGM 102). In some arrangements, the names of the players occupying the specific EGMs may be hidden from the player of EGM 102 even if the gaming system knows the names of the other players. For example, the gaming system may in fact know the name of the player of EGM 103, but that player may have indicated not to share his or her name with other players. Accordingly, the name of the player of EGM 103 may not be shared with the player of EGM 102.

To share an object with another gaming machine, the player may drag an object from the object sharing area and drop the object onto the icon of the recipient gaming machine. For example, if the player and wishes to share an object with a player sitting at EGM 101, the player will select the object, and drag the object to the icon for EGM 101. Alternatively, the player may first select an object and then select a destination to share the object (e.g., as two separate touches instead of a drag and drop input). For example, if the player wishes to share an object with a player sitting at EMG 103, the player will select the object by touching the object on user interface 300 and then touch the icon corresponding to EGM 103. Other than how the player initiates the sharing transaction, the gaming system of FIG. 3 operates in the same manner as the gaming system of FIG. 2. Accordingly, prior to completing the sharing transaction, the gaming system may request confirmation of the player's intention to share the selected object with the selected destination.

Figure 4:
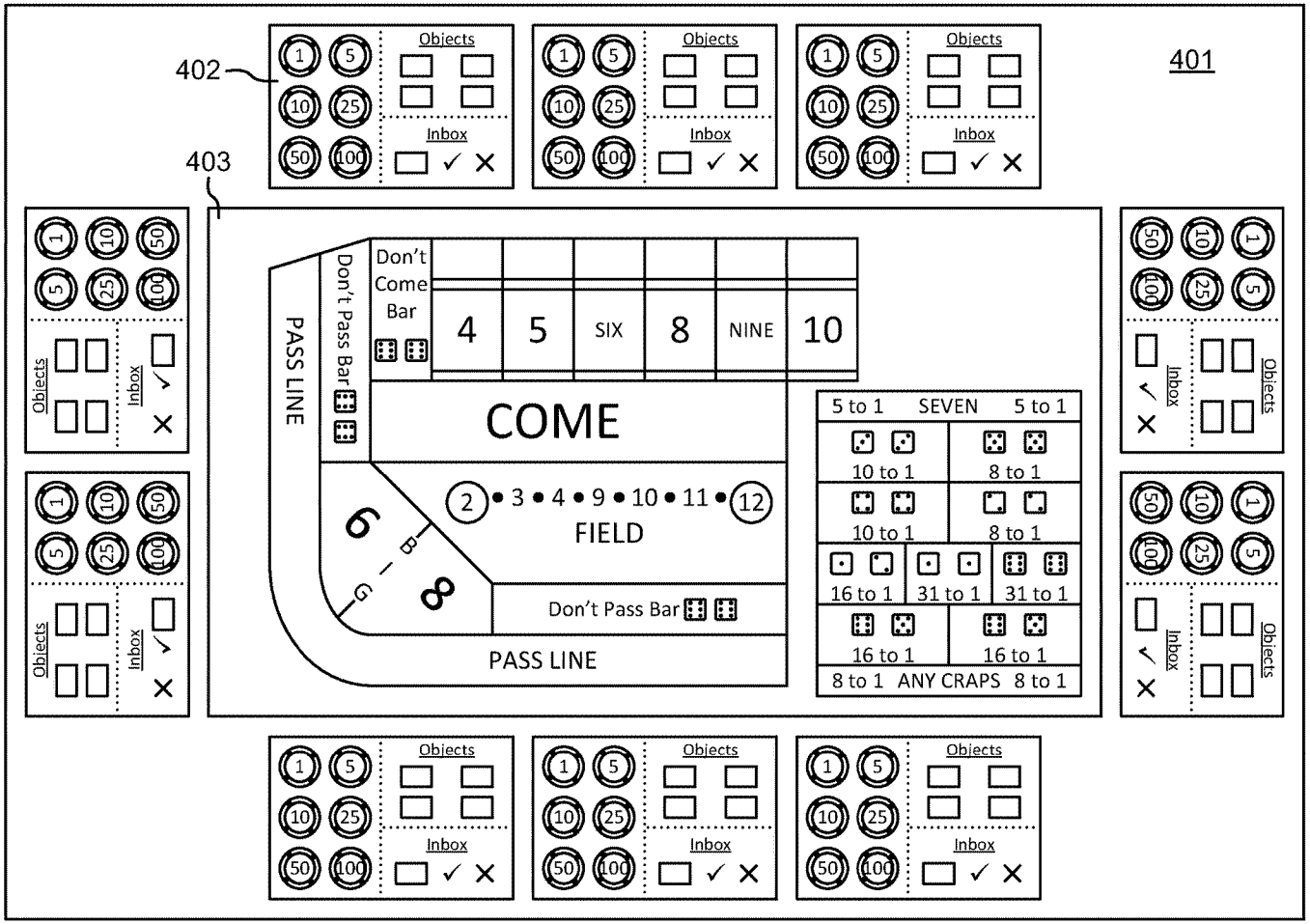
FIG. 4 is an overhead view of a smart gaming table shown according to an exemplary embodiment.

Referring to FIG. 4, a smart gaming table 400 is shown according to an exemplary embodiment. Table 400 includes table surface 401. Table surface 401 may include a plurality of player station displays 402 and a main table display 403 coupled to the table surface 401. Each player station display 402 may present a similar user interface to those discussed above with respect to FIG. 2 and FIG. 3. The player stations 402 may be positioned around the main table display 403 and about a periphery of the table surface 401. The player stations 402 may at least partially surround the main table display 403. Accordingly, players playing a game at table 400 may share objects with other players at table 400. Although shown as having ten player station displays 402, any number of player station displays may be positioned on table 400. Additionally, one or more of the player station displays 402 may be reconfigured as a dealer station. Still further, although table 400 is shown as having a plurality of individual player station displays 402 and a separate main table display 403, table 400 may include one large display panel that is divided into a plurality of player station areas (e.g., about the periphery of the display) and a main game play area (e.g., in the center of the display and at least partially surrounded by the plurality of player station areas). Each display of table 400 may be a touchscreen display configured to receive touch input from a user.

The user interface presented on any of the player station displays 402 may facilitate object sharing with other players at table 400 by the swiping method (i.e., in the same manner as discussed above with respect to FIG. 2). Accordingly, a player may select an object and swipe it in the direction of another player. The table gaming system receives information relating to the player's swiping motion of a selected object (e.g., swipe direction, swipe speed, contact pressure between the player's finger and the touchscreen, object characteristics, etc.), analyzes the information relating to the player's swiping motion, and determines a destination of the shared object. The table gaming system may be programmed to be spatially aware of the layout of player station displays 402 on the gaming table 400. Based at least in part on the spatial relationships between various player station displays 402 and the information relating to the player's swiping motion, the table gaming system determines the appropriate destination of the object. The table gaming system may employ a physics engine to assist with the destination determination. The destination determination may be made locally by a controller of gaming table 400 and/or remotely by a controller of a gaming server connected to the table 400. The gaming table may include a local controller configured to facilitate the sharing of objects. Alternatively, the gaming table may be coupled to a remote server that is configured to facilitate the sharing of objects.

The user interface presented on any of the player station displays 402 may facilitate object sharing with other players at table 400 by the drag and drop method (i.e., in the same manner as discussed above with respect to FIG. 3). Accordingly, the user interface may include a graphical representation of the layout of the player stations 402 and the main table display 403. As in user interface 300, the graphical representation of the layout of the table 400 may include player names if available. To share an object with another player station 402, the player may drag an object from the object sharing area and drop the object onto the icon of the recipient gaming machine.

Additionally, players may share objects with the main table display 403 in the same manner as objects are shared with other players. The objects may be shared with the main table display 403 via either the swiping method or the drag and drop method. For example, if table 400 is used to play a poker game, a player may fold a hand of poker by swiping his cards towards the main table display 403. As an additional example, if a player wishes to place a bet during a game (e.g., during the game of craps shown in FIG. 4), the player may touch the appropriate virtual chips presented on the displayed graphical user interface and then touch an area of a representation of the betting area on the player station display 402 to place the bet.

Figure 5:
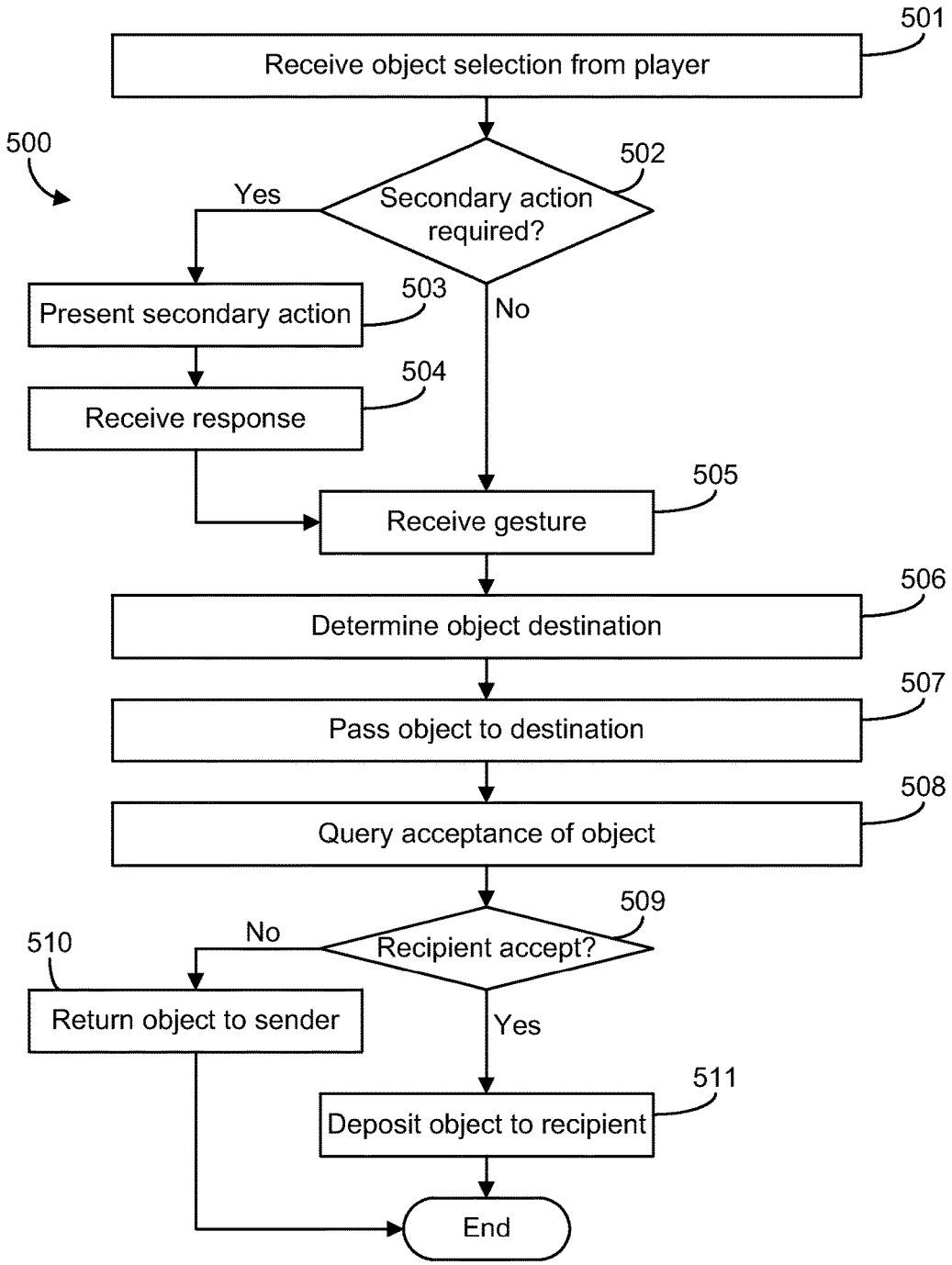
FIG. 5 is a flow diagram of a method of performing an object sharing transaction in a gaming system shown according to an exemplary embodiment

Referring to FIG. 5, a method 500 of performing an object sharing transaction in a gaming system is shown according to an exemplary embodiment. Method 500 may be carried out in a gaming system having a plurality of gaming machines (e.g., as discussed above with respect to FIGS. 1-3) and/or a smart gaming table (e.g., as discussed above with respect to FIG. 4). The various steps of method 500 may be performed locally by a controller or processor of a gaming machine (e.g., EGM 101) or a smart table (e.g., table 400) and/or remotely at a controller of a gaming server connected to the gaming machine or smart table.

Method 500 begins when the gaming system receives an object selection from a player at 501. The player makes a selection through a user interface presented on the player display (e.g., user interface 200, user interface 300, or the user interface presented via player display 402). The objects may be non-gaming related objects. For example, the object may be a complimentary drink or meal voucher, a message, a link to a news article, a video clip, etc. The objects may relate to gaming related objects. For example, the object may be a number of gaming credits, a screenshot of the player's gameplay area 201, a card or game object in a communal game (e.g., a card in hearts that is passed from one player's hand to another player's hand), an intra-bet proposition between two players, an invitation to join a group bonus event, etc.

The gaming system determines whether the selected object requires a secondary action at 502. Some shared objects may require an intermediate step between user selection of the object and sending of the object to the destination. For example, if a player wishes to send a message to another player, the player will need to provide the text of the message to be sent. As an additional example, a player may select to share a credit amount that differs from a common credit amount (i.e., a different amount than the $1 credit 207 or the $5 credit 208 as discussed above with respect to FIG. 2). Accordingly, the player may need to provide the desired credit amount to the gaming system prior to sending the credit amount to the recipient player.

If a secondary action is required, the gaming system presents the sending player a graphical user interface requesting the information necessary to complete the secondary action at 503. As noted above, for example, the secondary action may be the composing of a message. Accordingly, the gaming system may present the user an on-screen keyboard such that the user can compose the message. Other secondary actions may correspond to the selection of a denomination for an amount of shared credits, a selection of a news article from a listing of articles for the sharing of a news story, a selection of a video from a listing of videos for the sharing of a news video, and the like. The gaming system receives the player response to the secondary action request at 504.

The gaming system receives gesture information at 505. The gaming system is configured to enable the player to send the selected object by swiping the object across the user interface (e.g., by swiping the object to in the direction of the desired recipient player as discussed above with respect to FIG. 2). Accordingly, the player interacts with the graphical user interface by pressing on the object and swiping the object in the direction of the recipient. The gaming system receives information relating to the player's swiping motion of a selected object (e.g., swipe direction, swipe speed, contact pressure between the player's finger and the touch-screen, object characteristics, etc.). In some arrangements, the selection and the gesture information may be received in one touch of the user. In such arrangements, the gesture information is received prior to determining whether a secondary action is required at 502.

The gaming system determines the shared object's destination at 506. The gaming system analyzes the information relating to the player's swiping motion, and determines a proper destination of the shared object. The gaming system may be programmed to be spatially aware of the layout of EGMs within the gaming system or the positions of player stations at the gaming table. Alternatively, the gaming system may receive real-time spatial information relating to the relative positions and orientations of the EGMs (e.g., via GPS, via IR beacons, via wireless triangulation, etc.). Based at least in part on the spatial relationships between various EGMs or player stations and the information relating to the player's swiping motion, the gaming system determines the appropriate destination of the object. The gaming system may employ a physics engine to assist with the destination determination.

In some arrangements, the gaming system may prompt the sending player for a confirmation that the determined destination matches the player's intended destination. For example, after a player selects and swipes a complimentary drink voucher, the system may prompt the user with a message "Are you sure that you want to send the player two machines to your right a complimentary drink voucher?" The message may include options to confirm the transaction, to cancel the transaction, or to manually select a different recipient. If the system receives an indication that the player elects to manually select a different recipient, the system may present the player a visual representation of a floor plan of an area of the gaming floor including nearby EGMs or a layout of the smart gaming table. The player may then provide the gaming system the location or identity of the intended recipient.

The gaming system passes the shared object to the destination at 507. The gaming system may provide an animation on the sending player's display showing the object leaving the sending player's available objects. The gaming system may provide an animation to the recipient player's display showing the object entering the recipient player's available objects. The gaming system may provide animations on any player displays positioned spatially in between the sending player and the recipient player. In some cases, the players positioned in between the sending player and the recipient player may be able to interact with the animation. For example, the players may attempt to steal an object by grabbing it as it passes over their screen. As an additional example, the player may swipe the object across their screen to assist with the passing of the object from the sending player to the recipient player.

The gaming system queries the recipient player whether the recipient player will accept the shared object at 508. The query may come in the form of a pop-up notification presented on the user interface of the recipient player's display. In alternative arrangements, the query may be presented in an object inbox presented on the user interface of recipient player's display. After the query, the gaming system determines whether the recipient player will accept the object at 509. If the recipient does not accept the shared object, the gaming system returns the shared object to the sending player at 510. If the recipient accepts the shared object, the gaming system deposits the object with the recipient at 511. Both a visual representation of the object (e.g., an icon of a casino chip) and an intangible characteristic of the object (e.g., a number of credits) may then be debited from the sending player's account and deposited in the receiving player's account. For example, if the shared object relates to a number of gaming credits and the recipient accepts, the gaming system deposits the number of gaming credits to the recipient player's account and debits the number of gaming credits from the sending player's account. In some situations, the gaming system may debit the intangible characteristic from the sending player's account and hold the intangible characteristic in escrow until the recipient player accepts or rejects the transfer, upon which the intangible characteristic is then either credited to the recipient's account or returned to the sender's account.

Figure 6:
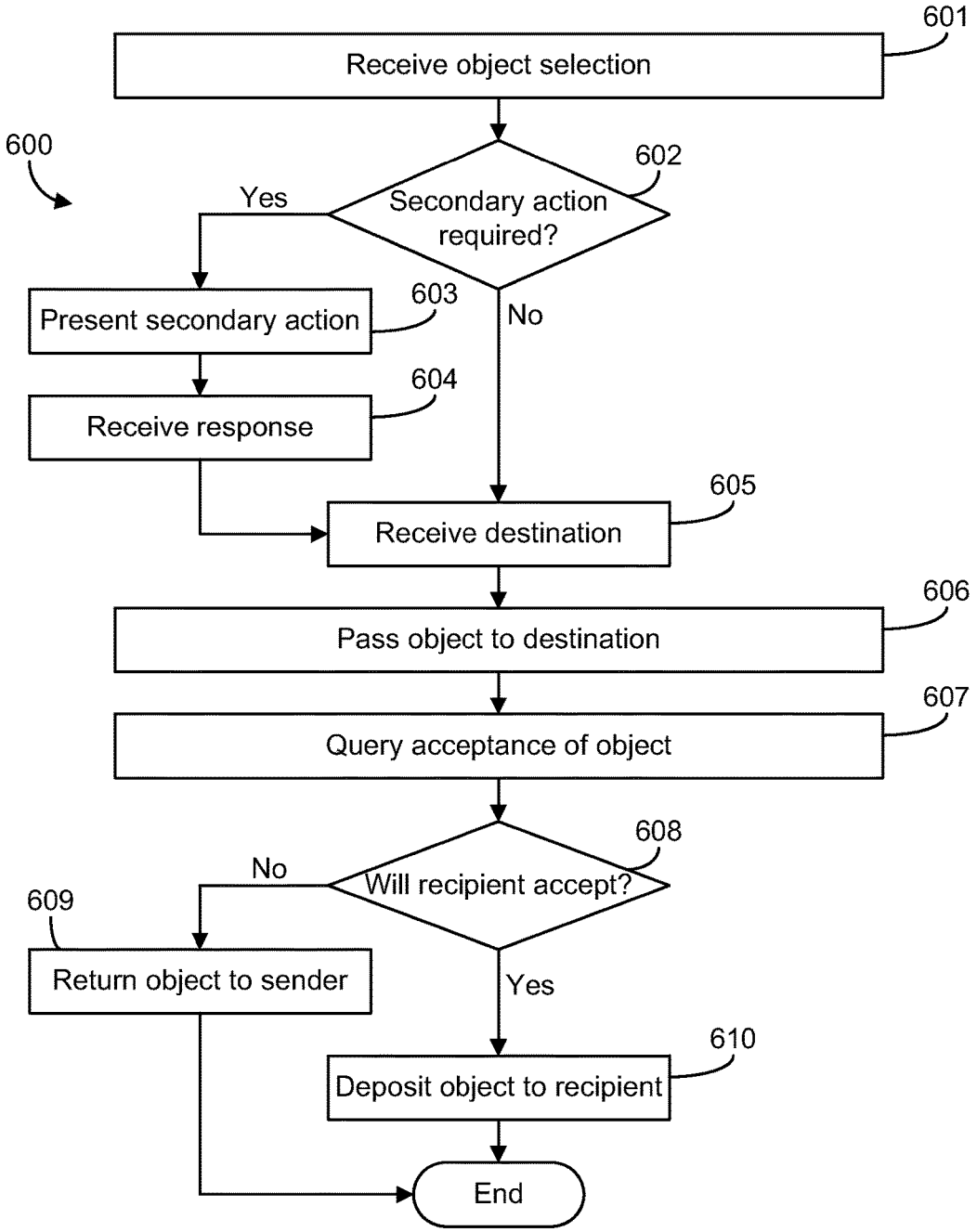
FIG. 6 is flow diagram of a method of performing an object sharing transaction in a gaming system shown according to an exemplary embodiment

Referring to FIG. 6, a method 600 of performing an object sharing transaction in a gaming system is shown according to an exemplary embodiment. Method 600 may be carried out in a gaming system having a plurality of gaming machines (e.g., as discussed above with respect to FIGS. 1-3) and/or a smart gaming table (e.g., as discussed above with respect to FIG. 4). The various steps of method 600 may be performed locally by a controller or processor of a gaming machine (e.g., EGM 101) or a smart table (e.g., table 400) and/or remotely at a controller of a gaming server connected to the gaming machine or smart table. Method 600 differs from method 500 in that the sending player initiates the sharing transaction by dragging and dropping the object to be shared to a specified player or player location on a representation of players or player locations (e.g., on a representation of a gaming floor layout or a gaming table).

Method 600 begins when the gaming system receives an object selection from a player at 601. The player makes a selection through a user interface presented on the player display (e.g., user interface 200, user interface 300, or the user interface presented via player display 402). The objects may be non-gaming related objects. For example, the object may be a complimentary drink or meal voucher, a message, a link to a news article, a video clip, etc. The objects may relate to gaming related objects. For example, the object may be a number of gaming credits, a screenshot of the player's gameplay area 201, a card or game object in a communal game (e.g., a card in hearts that is passed from one player's hand to another player's hand), an intra-bet proposition between two players, an invitation to join a group bonus event, etc.

The gaming system determines whether the selected object requires a secondary action at 602. Some shared objects may require an intermediate step between user selection of the object and sending of the object to the destination. For example, if a player wishes to send a message to another player, the player will need to provide the text of the message to be sent. As an additional example, a player may select to share a credit amount that differs from a common credit amount (i.e., a different amount than the $1 credit 207 or the $5 credit 208 as discussed above with respect to FIG. 2). Accordingly, the player may need to provide the desired credit amount to the gaming system prior to sending the credit amount to the recipient player.

If a secondary action is required, the gaming system presents the sending player a graphical user interface requesting the information necessary to complete the secondary action at 603. As noted above, for example, the secondary action may be the composing of a message. Accordingly, the gaming system may present the user an on-screen keyboard such that the user can compose the message. Other secondary actions may correspond to the selection of a denomination for an amount of shared credits, a selection of a news article from a listing of articles for the sharing of a news story, a selection of a video from a listing of videos for the sharing of a news video, and the like. The gaming system receives the player response to the secondary action request at 604.

The gaming system object destination information at 605. The user interface of the sending player's display facilitates the sharing of objects by presenting the player a graphical representation of available object destinations. The available object destinations may displayed in a virtual representation of a spatial layout of the available destinations (e.g., an overhead floor plan view of a gaming floor, a graphical representation of available player stations at a gaming table, etc.). The virtual representation of available destinations may disclose other players' identities at the available object destinations if the gaming system knows the names of the player (e.g., if the player is logged into his or her player loyalty account). The object destination information may relate to a selection of an available object destination. In some arrangements, the object selection and the destination information is received in one touch of the use (i.e., a single drag and drop input from the player as discussed above with respect to FIG. 3). In such arrangements, the object destination information is received prior to determining whether a secondary action is required at 602.

In some arrangements, the gaming system may prompt the sending player for a confirmation that the provided object destination matches the player's intended destination. For example, after a player selects an object and a destination for a complimentary drink voucher, the system may prompt the user with a message "Are you sure that you want to send the player two machines to your right a complimentary drink voucher?" The message may include options to confirm the transaction, to cancel the transaction, or to manually select a different recipient. If the system receives an indication that the player has selected the wrong destination at 605, the player can reselect the proper recipient of the object.

The gaming system passes the shared object to the destination at 606. The gaming system may provide an animation on the sending player's display showing the object leaving the sending player's available objects. The gaming system may provide an animation to the recipient player's display showing the object entering the recipient player's available objects. The gaming system may provide animations on any player displays positioned spatially in between the sending player and the recipient player.

The gaming system queries the recipient player whether the recipient player will accept the shared object at 607. The query may come in the form of a pop-up notification presented on the user interface of the recipient player's display. In alternative arrangements, the query may be presented in an object inbox presented on the user interface of recipient player's display. After the query, the gaming system determines whether the recipient player will accept the object at 608. If the recipient does not accept the shared object, the gaming system returns the shared object to the sending player at 609. If the recipient accepts the shared object, the gaming system deposits the object with the recipient at 610. For example, if the shared object relates to a number of gaming credits and the recipient accepts, the gaming system deposits the number of gaming credits to the recipient player's account. Both a visual representation of the object (e.g., an icon of a casino chip) and an intangible characteristic of the object (e.g., a number of credits) may then be debited from the sending player's account and deposited in the receiving player's account. For example, if the shared object relates to a number of gaming credits and the recipient accepts, the gaming system deposits the number of gaming credits to the recipient player's account and debits the number of gaming credits from the sending player's account. In some situations, the gaming system may debit the intangible characteristic from the sending player's account and hold the intangible characteristic in escrow until the recipient player accepts or rejects the transfer, upon which the intangible characteristic is then either credited to the recipient's account or returned to the sender's account.

It should be appreciated that the above-described embodiments of the present disclosure may be implemented in accordance with or in conjunction with one or more of a variety of different types of gaming systems, such as, but not limited to, those described above and below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines (EGMs); one or more smart game tables; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

In various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, a gaming system may include a plurality of EGMs that are each configured to communicate with a central server, central controller, or a remote host through a data network.

In certain embodiments in which the gaming system includes an EGM in combination with a central server, central controller, or remote host, the central server, central controller, or remote host is any suitable computing device (such as a server) that includes at least one processor and at least one memory device or storage device. The EGM may include at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs).

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (e.g., main cabinet 701 shown in FIG. 8). In other embodiments, at least one of the at least one processor of the EGM and the at least one memory device of the EGM reside outside the cabinet of the EGM.

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

In various embodiments, the EGM includes one or more input devices. The input devices may include any suitable device that enables an input signal to be produced and received by the at least one processor of the EGM. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. It should be appreciated that, in some embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display decreases by one, and a number of credits shown in a bet display increases by one.

In other embodiments, one input device of the EGM is a cash out device. The cash out device is utilized to receive a cash payment or any other suitable form of payment corresponding to a quantity of remaining credits of a credit display.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are inputted to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, one input device of the EGM is a card reader in communication with the at least one processor of the EGM. The card reader is configured to read a player identification card inserted into the card reader.

Figure 7:
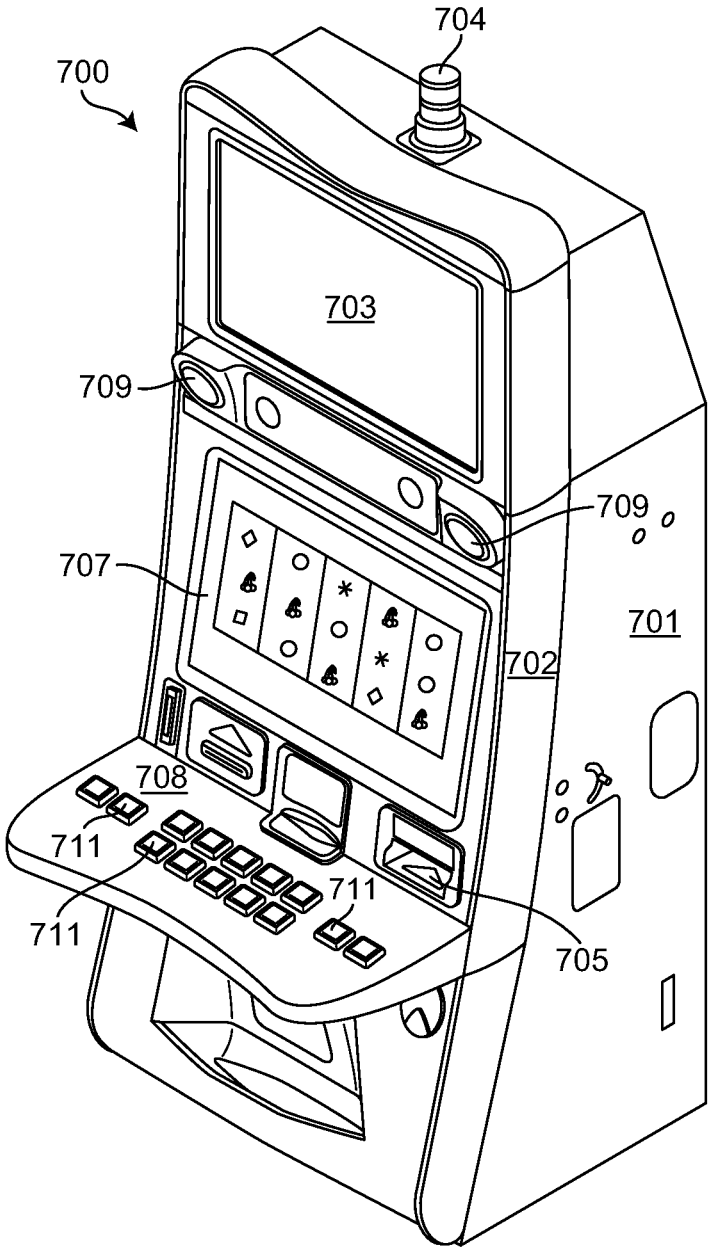
FIG. 7 is an illustration of a gaming device shown according to an exemplary embodiment.

In various embodiments, the EGM includes one or more output devices (e.g., display 703 shown in FIG. 7). One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status; (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. In another such embodiment, the EGM provides dynamic sounds coupled with attractive multimedia images displayed on one or more of the display devices to provide an audiovisual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games (in certain embodiments), and one or more secondary games (in other embodiments). In various embodiments, the primary game(s) and the secondary game(s) may comprise any suitable games and/or wagering games, such as, but not limited to: electromechanical or video slot or spinning reel type games; video card games, video draw poker, multi-hand video draw poker, other video poker games, video blackjack games, and video baccarat games; video keno games; video bingo games; and video selection games.

In certain embodiments in which the secondary game or the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. In certain embodiments, one or more of the reels are independent reels or unisymbol reels. In such embodiments, each independent reel generates and displays one symbol.

In certain such embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

Referring to FIG. 7, an example EGM for running or executing the games of the present disclosure is shown as electronic gaming device 700, in accordance with described embodiments. The gaming device 700 may include a main cabinet 701. The main cabinet 701 may provide a secure enclosure that prevents tampering with device components, such as a game controller (not shown) located within the interior of the main cabinet 701. The main cabinet 701 may include an access mechanism, such as a door 702, which allows the interior of the gaming device 700 to be accessed. Actuation of a door 702 may be controlled by a locking mechanism 814. In some embodiments, the locking mechanism 814, the door 702, and the interior of the main cabinet 701 may be monitored with security sensors of various types to detect whether the interior has been accessed. For instance, a light sensor may be provided within the main cabinet 701 to detect a change in light-levels when the door 702 is opened and/or an accelerometer may be attached to the door 702 to detect when the door 702 is opened.

The gaming device 700 may include any number of user interface devices that convey sensory information to a user and/or receive input from the user. For example, the gaming device 700 may include electronic displays 703, 707, speakers 709, and/or a candle device 704 to convey information to the user of the gaming device 700. The gaming device 700 may also include a console 708 having one or more inputs 711 (e.g., buttons, track pads, etc.) configured to receive input from a user. For instance, the player may place a wager, select the starter card 210, and/or select the discards 212 from the plurality of player cards 202 by manipulating the one or more inputs 711. In one embodiment, the display 703 and/or the display 707 may also be a touch screen display configured to receive input from a user. A controller (not shown) within the gaming device 700 may run a game, such as a wager-based game based on one or more of the processes 100, 600, and/or 700 described above, in response to receiving input from a user via the inputs 711, the display 707, or the display 703. For example, the inputs 711 may be operated by a player to play a game on the gaming device 700.

The gaming device 700 may also include devices for conducting a wager-based game. For example, the gaming device 700 may include a ticket acceptor 705 and a printer 706. In various embodiments, the gaming device 700 may be configured to run on credits that may be redeemed for money and/or other forms of prizes. The ticket acceptor 705 may read an inserted ticket having one or more credits usable to play a game on the gaming device 700. For example, a player of the gaming device 700 may wager one or more credits within a wager-based game. If the player loses, the wagered amount may be deducted from the player's remaining balance on the gaming device 700. However, if the player receives a payout, the player's balance may be increased by the amount of the payout. Any remaining credit balance on the gaming device 700 may be converted into a ticket via the printer 706. For example, a player of the gaming device 700 may cash out of the machine by selecting to print a ticket via the printer 706. The ticket may then be used to play other gaming machines or redeemed for cash and/or prizes. According to various embodiments, the gaming device 700 may record data regarding its receipt and/or disbursement of credits. For example, the gaming device 700 may generate accounting data whenever a result of a wager-based game is determined. In some embodiments, the gaming device 700 may provide accounting data to a remote data collection device, allowing the remote monitoring of the gaming device 700.

In one embodiment, the gaming device 700 may include a loyalty card acceptor 710. In general, a loyalty card may be tied to a user's loyalty account. A loyalty account may store various information about the user, such as the user's identity, the user's gaming preferences, the user's gaming habits (e.g., which games the user plays, how long the user plays, etc.), or similar information about the user. A loyalty account may also be used to reward a user for playing the gaming device 700. For example, a user having a loyalty account may be given a bonus turn on the gaming device 700 or credited loyalty points for playing the gaming device 700. Such loyalty points may be exchanged for loyalty rewards (e.g., a free meal, a free hotel stay, free room upgrade, discounts, etc.).

Implementations of the subject matter and the operations described in this specification can be implemented in digital electronic circuitry, or in computer software, firmware, or hardware, including the structures disclosed in this specification and their structural equivalents, or in combinations of one or more of them. Implementations of the subject matter described in this specification can be implemented as one or more computer programs, i.e., one or more modules of computer program instructions, encoded on one or more computer storage medium for execution by, or to control the operation of, data processing agent. Alternatively or in addition, the program instructions can be encoded on an artificially-generated propagated signal (e.g., a machine-generated electrical, optical, or electromagnetic signal) that is generated to encode information for transmission to suitable receiver agent for execution by a data processing agent. A computer storage medium can be, or be included in, a computer-readable storage device, a computer-readable storage substrate, a random or serial access memory array or device, or a combination of one or more of them. Moreover, while a computer storage medium is not a propagated signal, a computer storage medium can be a source or destination of computer program instructions encoded in an artificially-generated propagated signal. The computer storage medium can also be, or be included in, one or more separate components or media (e.g., multiple CDs, disks, or other storage devices). Accordingly, the computer storage medium may be tangible and non-transitory.

The operations described in this specification can be implemented as operations performed by a data processing agent on data stored on one or more computer-readable storage devices or received from other sources.

The term "client or "server" include all kinds of agent, devices, and machines for processing data, including by way of example a programmable processor, a computer, a system on a chip, or multiple ones, or combinations, of the foregoing. The agent can include special purpose logic circuitry, e.g., an FPGA (field programmable gate array) or an ASIC (application-specific integrated circuit). The agent can also include, in addition to hardware, code that creates an execution environment for the computer program in question, e.g., code that constitutes processor firmware, a protocol stack, a database management system, an operating system, a cross-platform runtime environment, a virtual machine, or a combination of one or more of them. The agent and execution environment can realize various different computing model infrastructures, such as web services, distributed computing and grid computing infrastructures.

A computer program (also known as a program, software, software application, script, or code) can be written in any form of programming language, including compiled or interpreted languages, declarative or procedural languages, and it can be deployed in any form, including as a stand-alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub-programs, or portions of code). A computer program can be deployed to be executed on one computer or on multiple computers that are located at one site or distributed across multiple sites and interconnected by a communication network.

The processes and logic flows described in this specification can be performed by one or more programmable processors executing one or more computer programs to perform actions by operating on input data and generating output. The processes and logic flows can also be performed by, and agent can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read-only memory or a random access memory or both. Devices suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto-optical disks; and CD-ROM and DVD-ROM disks. The processor and the memory can be supplemented by, or incorporated in, special purpose logic circuitry.

To provide for interaction with a user, implementations of the subject matter described in this specification can be implemented on a computer having a display device, e.g., a CRT (cathode ray tube), LCD (liquid crystal display), OLED (organic light emitting diode), TFT (thin-film transistor), plasma, other flexible configuration, or any other monitor for displaying information to the user and a keyboard, a pointing device, e.g., a mouse, trackball, etc., or a touch screen, touch pad, etc., by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input. In addition, a computer can interact with a user by sending documents to and receiving documents from a device that is used by the user; for example, by sending webpages to a web browser on a user's client device in response to requests received from the web browser.

Implementations of the subject matter described in this specification can be implemented in a computing system that includes a back-end component, e.g., as a data server, or that includes a middleware component, e.g., an application server, or that includes a front-end component, e.g., a client computer having a graphical user interface or a Web browser through which a user can interact with an implementation of the subject matter described in this specification, or any combination of one or more such back-end, middleware, or front-end components. The components of the system can be interconnected by any form or medium of digital data communication, e.g., a communication network. Examples of communication networks include a local area network ("LAN") and a wide area network ("WAN"), an internetwork (e.g., the Internet), and peer-to-peer networks (e.g., ad hoc peer-to-peer networks).

While this specification contains many specific implementation details, these should not be construed as limitations on the scope of any inventions or of what may be claimed, but rather as descriptions of features specific to particular implementations of particular inventions. Certain features that are described in this specification in the context of separate implementations can also be implemented in combination in a single implementation. Conversely, various features that are described in the context of a single implementation can also be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking or parallel may be utilized.

The invention is claimed as follows:

1. A method of operating a gaming system, the method comprising:

receiving, via a first touchscreen of a first wagering gaming machine, a selection of an object by a first player;

thereafter, receiving, via the first touchscreen, a gesture associated with the selected object;

determining, by a controller of the gaming system and based at least in part on the received gesture, if the selected object is to be transferred to a second wagering gaming machine, wherein:

a first received gesture is associated with identifying the second wagering gaming machine and, when received, causes a transferring of the selected object to the second wagering gaming machine, the first received gesture is not associated with identifying any wagering gaming machine different than the second wagering gamine machine and, when received, does not cause any transferring of the selected object to any wagering gaming machine different than the second wagering gaming machine, a second, different received gesture is associated with and, when received, does not cause any transferring of the selected object to the second wagering gaming machine, the first received gesture has a first swipe speed, a first swipe direction and a first touch pressure, the second received gesture has a second swipe speed, a second swipe direction and a second touch pressure, and at least one of the first and second swipe speeds, the first and second swipe directions and the first and second touch pressures are different; and responsive to a determination that the selected object is to be transferred to the second wagering gaming machine, transferring, by the controller, data associated with the selected object from the first wagering gaming machine to the second wagering gaming machine.

2. The method of claim 1, further comprising querying a second player, via a second touchscreen of the second wagering gaming machine, for an acceptance of the selected object.

3. The method of claim 2, further comprising:

determining that the second player rejects the selected object, and in response to determining that the second player rejects the selected object, transmitting data associated with the rejection of the selected object to the first wagering gaming machine.

4. The method of claim 1, further comprising determining that the object requires a secondary action from the first player prior to transferring the data associated with selected object to the second wagering gaming machine.

5. The method of claim 4, further comprising receiving information relating to the secondary action from the first player via the first touchscreen.

6. The method of claim 5, wherein the selected object is a message and the information relating to the secondary action is a text of the message.

7. The method of claim 5, wherein the selected object is a game credit and the information relating to the secondary action is an amount of the game credit.

8. The method of claim 7, further comprising debiting the amount of game credit from a first player account and crediting the amount of game credit to a second player account.

9. The method of claim 1, further comprising receiving spatial relationship information defining a spatial relationship between the first wagering gaming machine and the second wagering gaming machine.

10. The method of claim 9, wherein the determining that the selected object is to be transferred to the second wagering gaming machine is based at least in part on the spatial relationship.

11. The method of claim 1, wherein the controller utilizes a physics engine in determining that the selected object is to be transferred to the second wagering gaming machine.

12. The method of claim 1, wherein the received gesture relates to the first player swiping the selected object across the first touchscreen towards the second wagering gaming machine.

13. The method of claim 1, wherein the received gesture relates to the first player dragging the selected object across the first touchscreen and dropping the selected object on an icon corresponding to the second wagering gaming machine.

14. The method of claim 1, wherein the determination of if the selected object is to be transferred to the second gaming machine is based on at least one characteristic associated with the selected object.

15. A method of operating a gaming system, the method comprising:

receiving, via a first touchscreen of a first playing station of a gaming table, a selection of an object by a first player at the first playing station;

thereafter, receiving, via the first touchscreen, a gesture associated with the selected object;

determining, by a processor of the gaming table and based at least in part on the received gesture information, if the selected object is to be transferred to a second playing station of the gaming table, wherein:

a first received gesture is associated with identifying the second playing station and, when received, causes a transferring of the selected object to the second playing station, the first received gesture is not associated with identifying any playing station different than the second playing station and, when received, does not cause any transferring of the selected object to any playing station different than the second playing station, a second, different received gesture is associated with and, when received, does not cause any transferring of the selected object to the second playing station, the first received gesture has a first swipe speed, a first swipe direction and a first touch pressure, the second received gesture has a second swipe speed, a second swipe direction and a second touch pressure, and at least one of the first and second swipe speeds, the first and second swipe directions and the first and second touch pressures are different; and responsive to a determination that the selected object is to be transferred to the second playing station, transferring, by the processor, data associated with the selected object from the first playing station to the second playing station.

16. The method of claim 15, further comprising querying a second player, via a second touchscreen of the second playing station, for an acceptance of the selected object.

17. The method of claim 16, further comprising:

determining that the second player rejects the selected object, and in response to determining that the second player rejects the selected object, transmitting data associated with the rejection of the selected object to the first playing station.

18. The method of claim 15, further comprising determining that the selected object requires a secondary action from the first player prior to transferring the selected object from the first playing station to the second playing station.

19. The method of claim 18, further comprising receiving information relating to the secondary action from the first player via the first touchscreen.

20. The method of claim 19, wherein the selected object is a message and the information relating to the secondary action is a text of the message.

21. The method of claim 19, wherein the selected object is a game credit and the information relating to the secondary action is an amount of the game credit.

22. The method of claim 15, further comprising receiving spatial relationship information defining a spatial relationship between the first playing station and the second playing station.

23. The method of claim 22, wherein the determining that the selected object is to be transferred to the second playing station is based at least in part on the spatial relationship.

24. The method of claim 15, wherein the processor utilizes a physics engine in determining that the selected object is to be transferred to the second playing station.

25. The method of claim 15, wherein the received gesture relates to the first player swiping the selected object across the first touchscreen towards the second playing station.

26. The method of claim 15, wherein the received gesture relates to the first player dragging the selected object across the first touchscreen and dropping the selected object on an icon corresponding to the second playing station.

27. The method of claim 15, wherein the determination of if the selected object is to be transferred to the second playing station is based on at least one characteristic associated with the selected object.

28. A gaming table comprising:

a game table surface;

a plurality of player stations positioned about a periphery of the game table surface; and a controller configured to:

receive a selection of an object by a player at a first player station of the plurality of player stations, thereafter, receive, from the first player station, a gesture associated with the selected object, determine, based at least in part on the received gesture, if the object is to be transferred to a second player station of the plurality of player stations, wherein:

a first received gesture is associated with identifying the second player station and, when received, causes a transferring of the selected object to the second player station, the first received gesture is not associated with identifying any player station different than the second player station and, when received, does not cause any transferring of the selected object to any player station different than the second player station, a second, different received gesture is associated with and, when received, does not cause any transferring of the selected object to the second player station, the first received gesture has a first swipe speed, a first swipe direction and a first touch pressure, the second received gesture has a second swipe speed, a second swipe direction and a second touch pressure, and at least one of the first and second swipe speeds, the first and second swipe directions and the first and second touch pressures are different, and responsive to a determination that the selected object is to be transferred to the second player station, transfer data associated with the selected object from the first player station to the second player station.

29. The gaming table of claim 28, which includes a main gaming display device coupled to the game table surface, wherein the main gaming display device is at least partially surrounded by the plurality of player stations.

30. The gaming table of claim 28, which includes a display device coupled to the gaming table, wherein each of the plurality of player stations is a separate area of the display.

31. The gaming table of claim 30, wherein the display device includes a main game play area positioned in a central area of the display device that is at least partially surrounded by the plurality of player stations.

32. The gaming table of claim 28, wherein the controller is further configured to query, via the second player station, an acceptance of the selected object.

33. The gaming table of claim 32, wherein the controller is further configured to:

determine that a player at the second player station rejects the selected object, and in response to determining that the second player rejects the selected object, transmit data associated with the rejection of the selected object to the first player station.

34. The gaming table of claim 28, wherein the controller is further configured to determine that the selected object requires a secondary action from the first player prior to transferring the selected object from the first player station to the second player station.

35. The gaming table of claim 34, wherein the selected object is a message and the information relating to the secondary action is a text of the message.

36. The gaming table of claim 34, wherein the selected object is a game credit and the information relating to the secondary action is an amount of the game credit.

37. The gaming table of claim 28, wherein the controller is programmed with spatial information defining the spatial relationship between the plurality of player stations, and wherein the controller is further configured to determine that the selected object is to be transferred to the second player based at least in part on the spatial relationship.

38. The gaming table of claim 28, further including a physics engine, wherein the controller utilizes a physics engine in determining that the selected object is to be transferred to the second player station.

39. The gaming table of claim 28, wherein each of the plurality of player stations includes a touchscreen display.

40. The gaming table of claim 39, wherein the received gesture relates to the player at the first player station swiping the selected object across a touchscreen of the first player station towards the second player station.

41. The gaming table of claim 39, wherein the received gesture relates to the player at the first player station dragging the selected object across a touchscreen of the first player station and dropping the selected object on an icon corresponding to the second player station.

42. The gaming table of claim 28, wherein the determination of if the selected object is to be transferred to the second player station is based on at least one characteristic associated with the selected object.

* * * * *